US011937694B2

(12) United States Patent
zankich, jr.

(10) Patent No.: US 11,937,694 B2
(45) Date of Patent: Mar. 26, 2024

(54) ANTI-DROPPING STORAGE DRAWER

(71) Applicant: Kris sam zankich, jr., Los Gatos, CA (US)

(72) Inventor: Kris sam zankich, jr., Los Gatos, CA (US)

( * ) Notice: Subject to any disclaimer, the term of this patent is extended or adjusted under 35 U.S.C. 154(b) by 46 days.

(21) Appl. No.: 17/849,745

(22) Filed: Jun. 27, 2022

(65) Prior Publication Data

US 2023/0413998 A1 Dec. 28, 2023

(51) Int. Cl.
*A47B 88/50* (2017.01)
*A47B 88/90* (2017.01)

(52) U.S. Cl.
CPC ..... *A47B 88/50* (2017.01); *A47B 88/90* (2017.01)

(58) Field of Classification Search
CPC ..... A47B 88/50; A47B 88/60; A47B 88/90; A47B 88/975
See application file for complete search history.

(56) References Cited

U.S. PATENT DOCUMENTS 2,914,211 A * 11/1959 Deinlein ..... A47B 88/90 220/544
2,985,333 A * 5/1961 Kirkman ..... A47B 88/90 220/533
3,032,381 A * 5/1962 Boro ..... A47B 88/90 312/122
4,261,464 A * 4/1981 Maitland ..... H05K 13/0069 206/708
4,436,215 A * 3/1984 Kleinert ..... A47B 88/975 312/263
4,577,773 A * 3/1986 Bitel ..... B25H 3/02 206/561
4,722,453 A * 2/1988 Hamilton ..... B42F 17/12 206/425
5,607,215 A * 3/1997 Pacetti ..... A47B 88/975 312/348.3
2003/0227241 A1* 12/2003 LaBonia, Jr. ..... A47B 88/975 312/348.3
2004/0012312 A1* 1/2004 Hay ..... A47B 88/90 312/330.1
2004/0050750 A1* 3/2004 Hannan ..... A47B 88/994 206/570
2020/0275778 A1* 9/2020 Marriott ..... A47B 88/975
2021/0100362 A1* 4/2021 Moriarty, Jr. ..... A47B 67/04

* cited by examiner

*Primary Examiner* — Daniel J Rohrhoff
(74) *Attorney, Agent, or Firm* — Ashok Tankha

(57) ABSTRACT

An anti-dropping storage drawer (ADSD) includes a pair of side walls, a front wall, and a rear wall forming a rectangular-shaped box, a base portion, and at least one projection. The front and rear walls extend between the side walls. The base portion extends between bottom portions of the side walls and the front and rear walls. The side walls, the front and rear walls, and the base portion define a cavity. The side walls and the front and rear walls taper outward toward an opening of the cavity. The projection projects from an underside of the base portion. When the ADSD is pulled out of a slot in a storage unit and inclines forward, the projection on the underside of the base portion blocks a forward and downward movement of the ADSD out of the storage unit.

21 Claims, 23 Drawing Sheets

ANTI-DROPPING STORAGE DRAWER

FIELD OF THE INVENTION

The apparatus disclosed herein, in general, relates to furniture. More particularly, the apparatus disclosed herein relates to an anti-dropping storage drawer that does not slide and fall out of a cabinet.

BACKGROUND

A bin box or a storage bin is a common article-storage device. The storage bin is typically configured to be slid in and out of a vacant slot in a storage unit, for example, a drawer unit, a storage cabinet, etc. The storage bin is accessed by pulling the storage bin out of its slot from the storage unit. However, often times while pulling the storage bin out of its slot, a user inadvertently pulls out, for example, more than about half the length of the storage bin from the slot which may cause the section of the storage bin outside the storage unit to tip downwards, and further cause the entire storage bin to slide out of its slot and drop to a ground surface, for example, a floor. Furthermore, when the storage bin tips downward on being pulled out by about more than half its length, the contents of the storage bin may shift forward, increasing the probability and speed of the storage bin to slide out of its slot. On dropping to the floor, the storage bin may get damaged while also damaging any item stored in the storage bin. Furthermore, if the contents of the storage bin are heavy and fall on the user's feet, there is a high probability of injury to the user.

Furthermore, the user may have to use one of his hands to support the storage bin after the storage bin is pulled out of its slot in the storage unit, by more than about half the length of the storage bin, to load or unload various items into and out of the storage bin, and also to sort the items stored in the storage bin.

Hence, there is a long-felt yet unresolved need for a storage bin comprising an anti-drop mechanism that prevents the storage bin from sliding out of its slot in a storage unit and falling, when the user inadvertently pulls out, for example, more than about half the length of the storage bin from its slot. There is also a long-felt yet unresolved need for a storage bin that does not require the user's support after it is pulled out of its slot in the storage unit, by more than about half the length of the storage bin, to load or unload various items into and out of the storage bin, and also to sort the items stored in the storage bin.

SUMMARY OF THE INVENTION

This summary is provided to introduce a selection of concepts in a simplified form that are further disclosed in the detailed description of the invention. This summary is not intended to determine the scope of the claimed subject matter.

The apparatus disclosed herein addresses the above-recited need for a storage bin comprising an anti-drop mechanism that prevents the storage bin from sliding out of its slot in a storage unit, for example, a drawer unit, a storage cabinet, etc., and falling to a ground surface, for example, a floor, when the user inadvertently pulls out, for example, more than about half the length of the storage bin from its slot. The apparatus disclosed herein also addresses the above-recited need for a storage bin that does not require the user's support after it is pulled out of its slot in the storage unit, by more than about half the length of the storage bin, to load or unload various items into and out of the storage bin, and also to sort the items stored in the storage bin. The storage bin with the anti-drop mechanism is hereinafter referred to as the "anti-dropping storage drawer". The anti-dropping storage drawer disclosed herein comprises a generally rectangular-shaped box comprising a pair of side walls, a front wall, and a rear wall. The front wall and the rear wall extend between the pair of side walls. In an embodiment, the front wall and the rear wall are substantially perpendicular to the pair of side walls. The anti-dropping storage drawer further comprises a base portion extending between bottom portions of the pair of side walls, a bottom portion of the front wall, and a bottom portion of the rear wall. The pair of side walls, the front wall, the rear wall, and the base portion define a cavity within the generally rectangular-shaped box. The pair of side walls, the front wall, and the rear wall taper outward towards an opening of the cavity. The cavity is configured to store miscellaneous loose items, for example, screws, nuts, bolts, nails, powder, material, etc., that fits in the cavity. In an embodiment, the anti-dropping storage drawer further comprises a downwardly extending lip extending from a top of the front wall. The downwardly extending lip is configured to allow a user to grip and slide the anti-dropping storage drawer in and out of the slot in the storage unit.

The anti-dropping storage drawer disclosed herein further comprises at least one projection projecting from an underside of the base portion. In an embodiment, the anti-dropping storage drawer comprises multiple projections projecting from the underside of the base portion. In an embodiment, each projection is spaced apart from an adjacent projection projecting from the underside of the base portion. Furthermore, each projection projects downwards from the underside of the base portion. In an embodiment, the projection is one of a tab and a bump disposed on the underside of the base portion. In another embodiment, the projection is a rib disposed on the underside of the base portion. The rib is, for example, a rib that extends along a straight line, a chevron shaped rib, a zig zag shaped rib, etc. In an embodiment, the anti-dropping storage drawer comprises multiple ribs disposed on the underside of the base portion. The rib(s) is disposed substantially parallel to the front wall and the rear wall. Each rib is spaced apart from an adjacent rib disposed on the underside of the base portion. The ribs are disposed substantially parallel to each other on the underside of the base portion. In an embodiment, the rib(s) is configured to extend along a width of the anti-dropping storage drawer between the pair of side walls. In an embodiment, the rib(s) disposed on the underside of the base portion is configured to project downwards and substantially perpendicular to the underside of the base portion.

The anti-dropping storage drawer is configured to slide in and out of a slot in a storage unit, for example, a drawer unit, a storage cabinet, etc. The projections(s) on the underside of the base portion is configured to engage with a lower lip of the storage unit when the anti-dropping storage drawer is pulled out of the slot in the storage unit. When the anti-dropping storage drawer tips downward or inclines forward with respect to a horizontal plane, one projection blocks a forward and downward movement of the anti-dropping storage drawer out of the storage unit.

In an embodiment, each of the side walls comprises a ledge extending along a length of each side wall and located proximal to a mid-section of each side wall. The ledge is configured to separate each side wall into an upper section and a lower section. The ledge is configured to project outwards from a top of the lower section of each side wall.

The upper section of each side wall extends upwards from an edge of the ledge of each side wall.

In an embodiment, the anti-dropping storage drawer further comprises multiple divider slots disposed on inner surfaces of the upper sections of the pair of side walls, and multiple divider slots disposed on inner surfaces of the lower sections of the pair of side walls. In an embodiment, each of the divider slots disposed on the inner surfaces of the upper sections of the pair of side walls is aligned with a corresponding one of the divider slots disposed on the inner surfaces of the lower sections of the pair of side walls.

The structures of the anti-dropping storage drawer will be apparent with reference to the disclosure and drawings disclosed herein. In the disclosure and the drawings, particular embodiments of the anti-dropping storage drawer have been disclosed in detail as being indicative of some of the ways in which the concept of the anti-dropping storage drawer may be employed, but the anti-dropping storage drawer is not limited in scope. Rather, the anti-dropping storage drawer includes all changes, modifications and equivalents within the spirit and terms of the claims.

Structures that are disclosed and/or illustrated with respect to one embodiment may be used in the same way or in a similar way in one or more other embodiments and/or in combination with or instead of the structures of the other embodiments.

BRIEF DESCRIPTION OF THE DRAWINGS

The foregoing summary, as well as the following detailed description of the invention, is better understood when read in conjunction with the appended drawings. For illustrating the embodiments herein, exemplary constructions of the embodiments are shown in the drawings. However, the embodiments herein are not limited to the specific structures, components, and methods disclosed herein. The disclosure of a structure, or a component, or a method step referenced by a numeral in a drawing is applicable to the disclosure of that structure, or component, or method step shown by that same numeral in any subsequent drawing herein.

FIG. 9B exemplarily illustrates an enlarged view of a divider slot disposed on an inner surface of an upper section of a side wall of the embodiment of the anti-dropping storage drawer shown in FIG. 1A, and a divider slot disposed on an inner surface of a lower section of the side wall.

DETAILED DESCRIPTION OF THE INVENTION

Figure 1A:
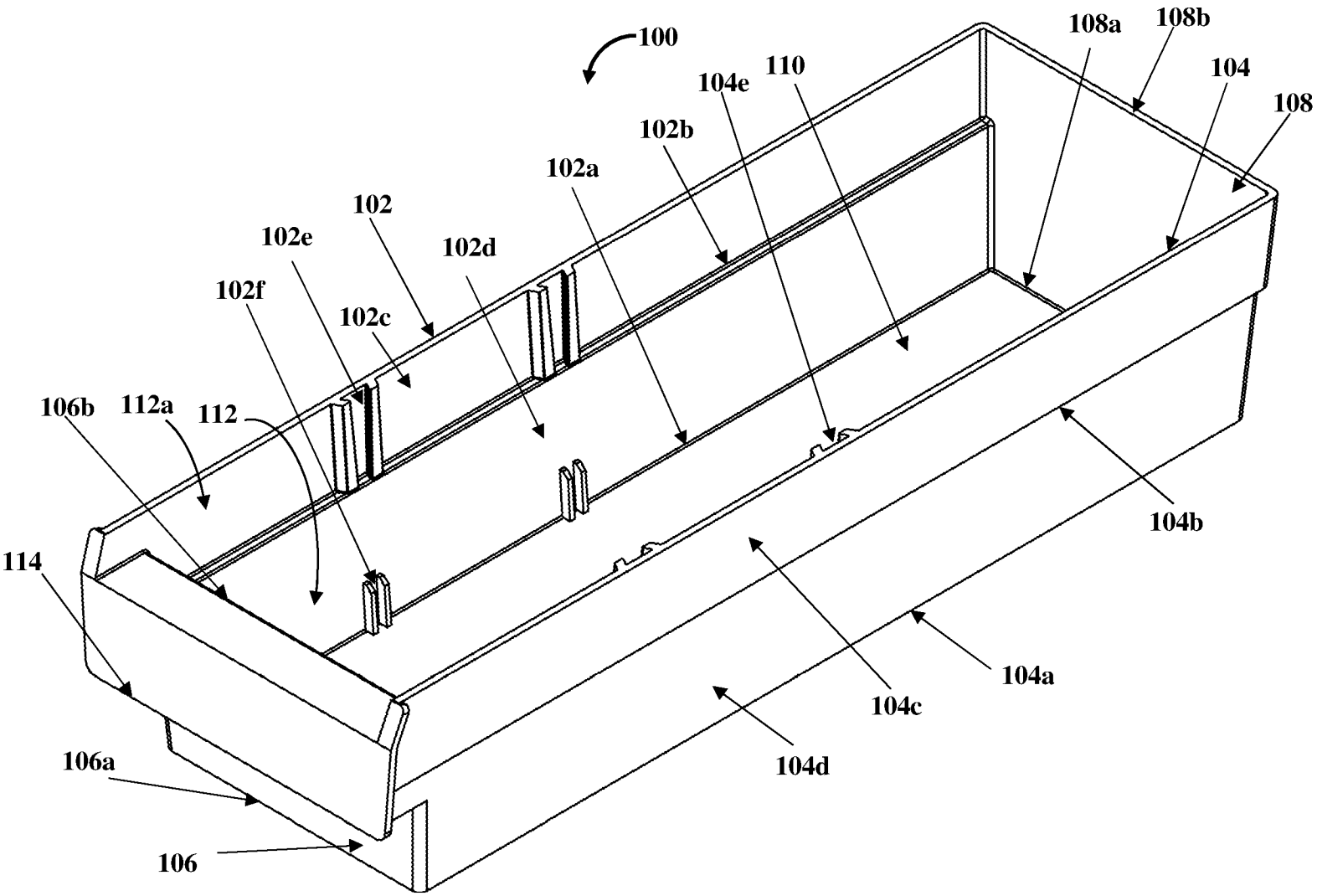
FIG. 1A exemplarily illustrates a front perspective view of an embodiment of an anti-dropping storage drawer.
Figure 1B:
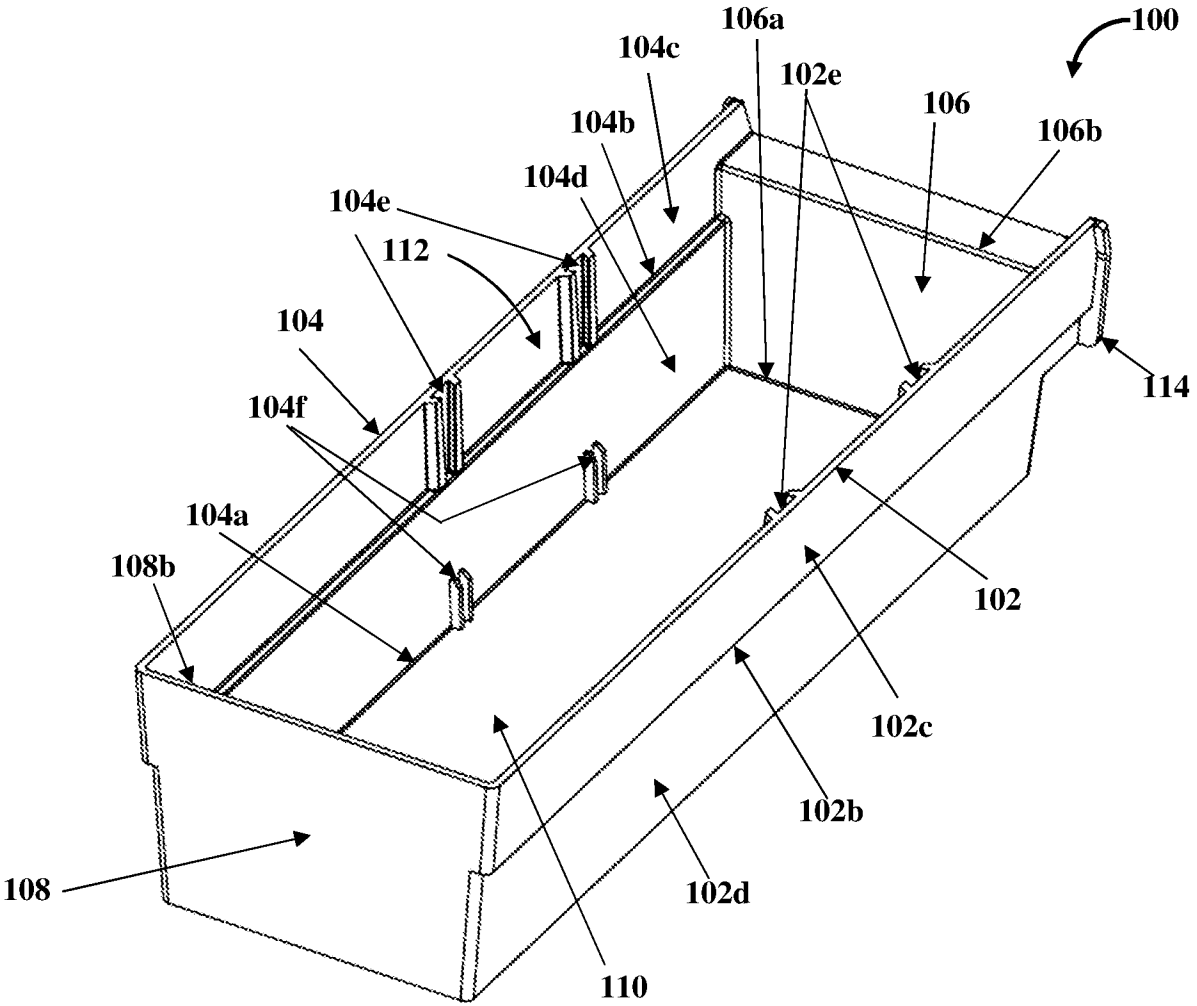
FIG. 1B exemplarily illustrates a rear perspective view of the embodiment of the anti-dropping storage drawer shown in FIG. 1A.

FIG. 1A and FIG. 1B exemplarily illustrate a front perspective view and a rear perspective view, respectively, of an embodiment of an anti-dropping storage drawer 100. The anti-dropping storage drawer 100 disclosed herein comprises a pair of side walls 102 and 104, a front wall 106, and a rear wall 108 together configured to form a generally rectangular-shaped box. The front wall 106 and the rear wall 108 extend between the pair of side walls 102 and 104. In an embodiment, the front wall 106 and the rear wall 108 are substantially perpendicular to the pair of side walls 102 and 104. The anti-dropping storage drawer 100 further comprises a base portion 110 extending between bottom portions, for example, bottom edges 102*a* and 104*a* of the pair of side walls 102 and 104, respectively, a bottom edge 106*a* of the front wall 106, and a bottom edge 108*a* of the rear wall 108 as exemplarily illustrated in FIG. 1A and FIG. 9A. The pair of side walls 102 and 104, the front wall 106, the rear wall 108, and the base portion 110 define a cavity 112 in the anti-dropping storage drawer 100. In an embodiment, the pair of side walls 102 and 104, the front wall 106, and the rear wall 108 taper outward towards an opening 112*a* of the cavity 112. The cavity 112 is configured to store miscellaneous loose items, for example, screws, nuts, bolts, nails, powder, and any material that fits in the cavity 112. The anti-dropping storage drawer 100 allows storage of a large number of items, for example, 240 items, within the cavity 112 of the anti-dropping storage drawer 100.

In an embodiment, the side walls 102 and 104 comprise respective ledges 102*b* and 104*b* extending along respective lengths of the side walls 102 and 104. The ledges 102*b* and 104*b* are configured to separate the side walls 102 and 104 into respective upper sections 102*c* and 104*c* and lower sections 102*d* and 104*d* as disclosed in the description of FIG. 9A. In another embodiment, the anti-dropping storage drawer 100 further comprises divider slots 102*e*, 102*f* and 104*e*, 104*f* disposed on the pair of side walls 102 and 104, respectively, as disclosed in the description of FIGS. 9A-9C. In an embodiment, the anti-dropping storage drawer 100 further comprises a downwardly extending lip 114 extending from a top 106*b* of the front wall 106. The downwardly extending lip 114 is configured to allow a user to grip and slide the anti-dropping storage drawer 100 in and out of a slot 1102 in a storage unit, for example, a drawer unit 1100 exemplarily illustrated in FIGS. 11A-11B and FIGS. 12A-12B, a storage cabinet, etc.

Figure 2A:
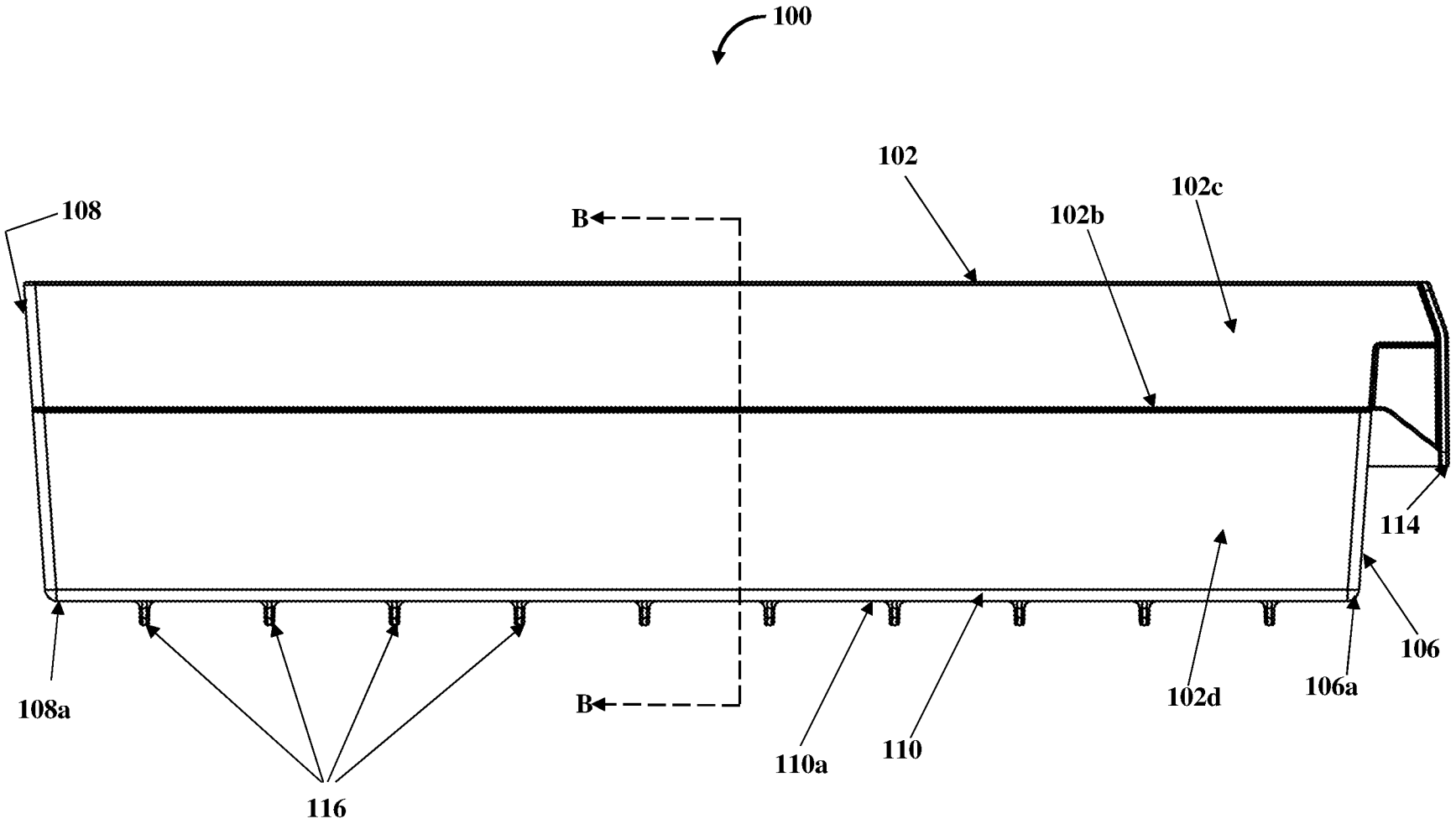
FIG. 2A exemplarily illustrates a left-side elevation view of the embodiment of the anti-dropping storage drawer shown in FIG. 1A.

FIG. 2A exemplarily illustrates a left-side elevation view of the embodiment of the anti-dropping storage drawer 100 shown in FIG. 1A. The anti-dropping storage drawer 100 disclosed herein further comprises at least on projection 116, 1300 and/or 1500 projecting from an underside 110*a* of the base portion 110, as illustrated in FIGS. 2A-5, 7, 8, 9C, 12C, 12D, and 13-16. In an embodiment, the anti-dropping storage drawer 100 comprises multiple projections 116, 1300 and/or 1500 projecting from the underside 110*a* of the base portion 110. In an embodiment, each projection 116, 1300 and/or 1500 is spaced apart from an adjacent projection 116, 1300 and/or 1500 projecting from the underside 110*a* of the base portion 110. Furthermore, each projection 116, 1300 and/or 1500 projects downwards from the underside 110*a* of the base portion 110. In an embodiment, the projection is either a tab 1500 illustrated in FIGS. 15 and 16, or a bump disposed on the underside 110*a* of the base portion 110.

In an embodiment (not shown), the anti-dropping storage drawer 100 comprises a single projection 116, 1300 and/or 1500 located at a predetermined location on the underside 110*a* of the base portion 110, for example, at a location more than about halfway from the front wall 106 along the length of the anti-dropping storage drawer 100. In an embodiment, the single projection 116, 1300 and/or 1500 is located at a location about halfway from the front wall 106 along the length of the anti-dropping storage drawer 100. In another embodiment, the single projection 116, 1300 and/or 1500 is located at a location less than about halfway from the front wall 106 along the length of the anti-dropping storage drawer 100. In another embodiment, in each of the three embodiments of the anti-dropping storage drawer 100 described in this paragraph, the single projection 116, 1300 and/or 1500 further comprises one or more projections 116, 1300 and/or 1500 located on the underside 110*a* of the base portion 110 on one or both sides of the single projection 116, 1300 and/or 1500.

Figure 13:
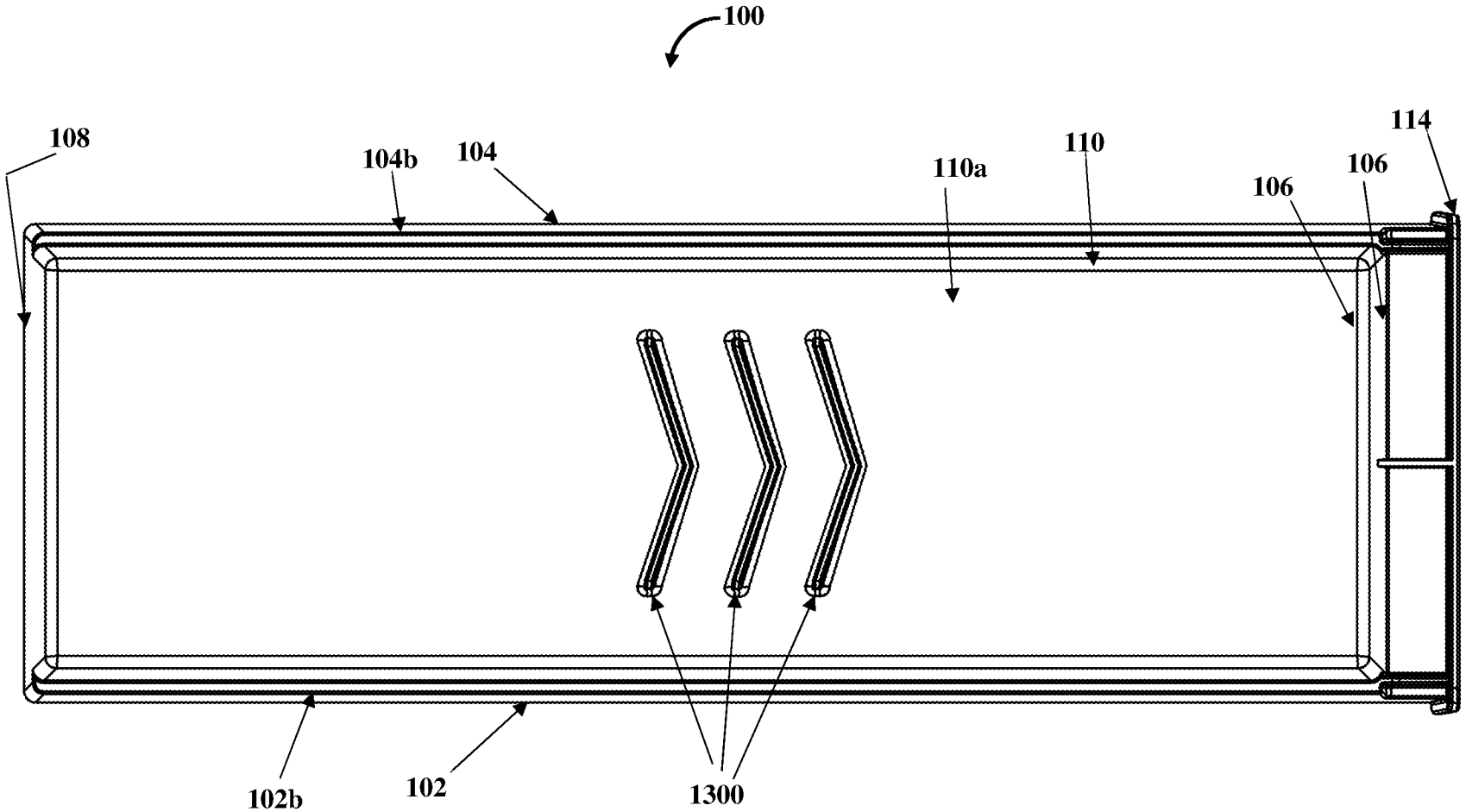
FIG. 13 exemplarily illustrates an embodiment of the anti-dropping storage drawer comprising chevron shaped ribs.
Figure 14:
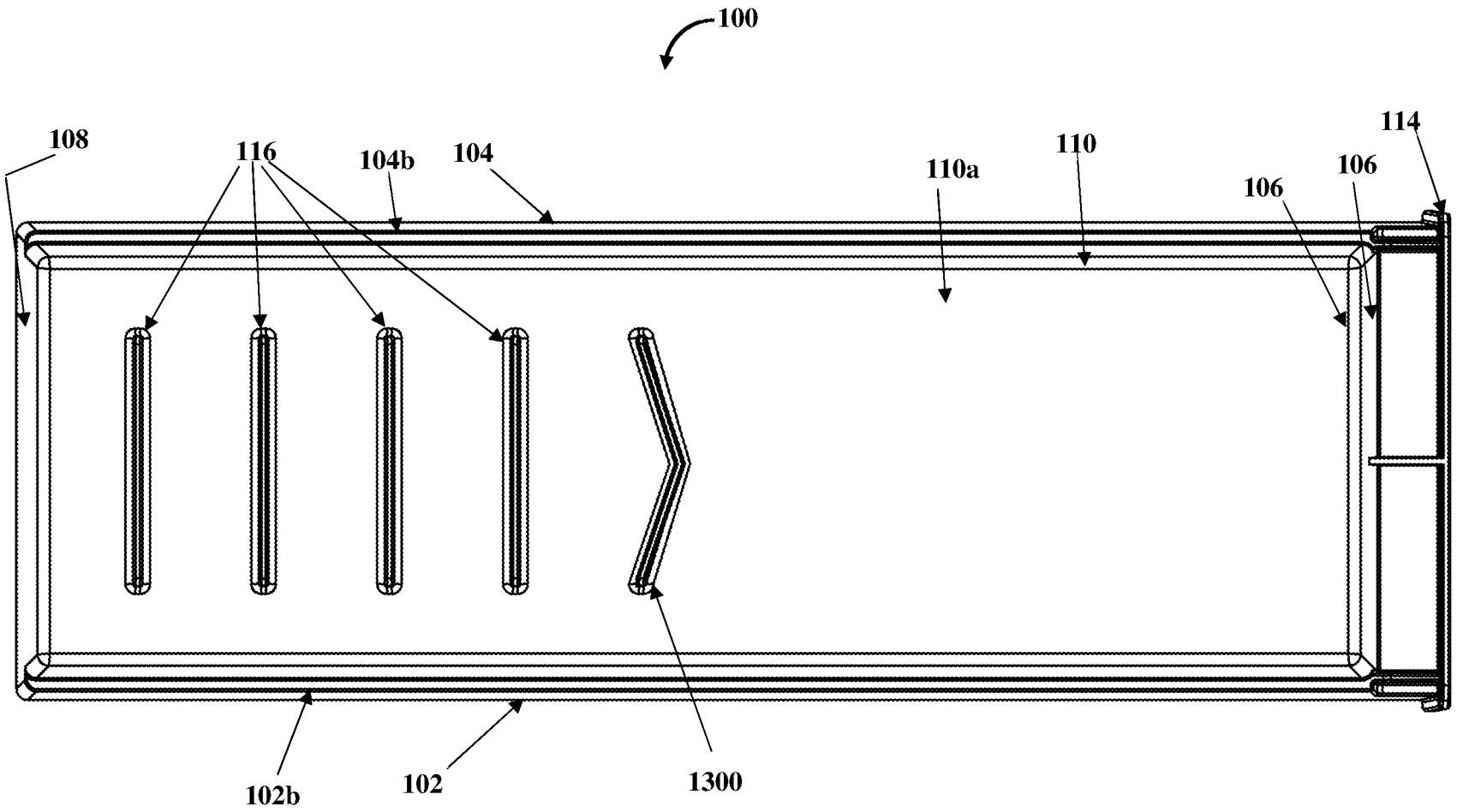
FIG. 14 exemplarily illustrates an embodiment of the anti-dropping storage drawer comprising both chevron shaped ribs illustrated in FIG. 13, and ribs that extend along a straight line as illustrated in FIGS. 2A-5, 7, 8, and 9C.

In another embodiment, the projection 116, 1300 and/or 1500 is a rib 116 disposed on the underside of the base portion. The rib 116 is, for example, a rib 116 that extends along a straight line, as shown in FIGS. 2A-5, 7, 8, 9C, 12C, 12D, and 14; a chevron shaped rib 1300, as shown in FIGS. 13 and 14, a zig zag shaped rib, etc. As illustrated in FIGS. 2A-5, 7, 8, 9C, 12C, 12D, the ribs 116 are disposed substantially parallel to the front wall 106 and the rear wall 108. Each rib 116 is spaced apart from an adjacent rib 116. Furthermore, the ribs 116 are disposed substantially parallel to each other on the underside 110*a* of the base portion 110. The ribs 116 disposed on the underside 110*a* of the base portion 110 are configured to project downward and substantially perpendicular to the underside 110*a* of the base portion 110.

One of the projections 116, 1300 and/or 1500 is configured to engage with a lower lip 1104 of a storage unit, for example, a drawer unit 1100 exemplarily illustrated in FIGS. 11A-11B and FIGS. 12A-12B, when the anti-dropping storage drawer 100 is pulled out of a slot 1102 in the drawer unit 1100, and block a forward and downward movement of the anti-dropping storage drawer 100 out of the drawer unit 1100 when the anti-dropping storage drawer 100 inclines forward with respect to a horizontal plane.

In an embodiment (not shown), the anti-dropping storage drawer 100 comprises only one rib 116 disposed at a predetermined location on the underside 110*a* of the base portion 110, for example, at a location more than about halfway the length of the anti-dropping storage drawer 100.

Figure 2B:
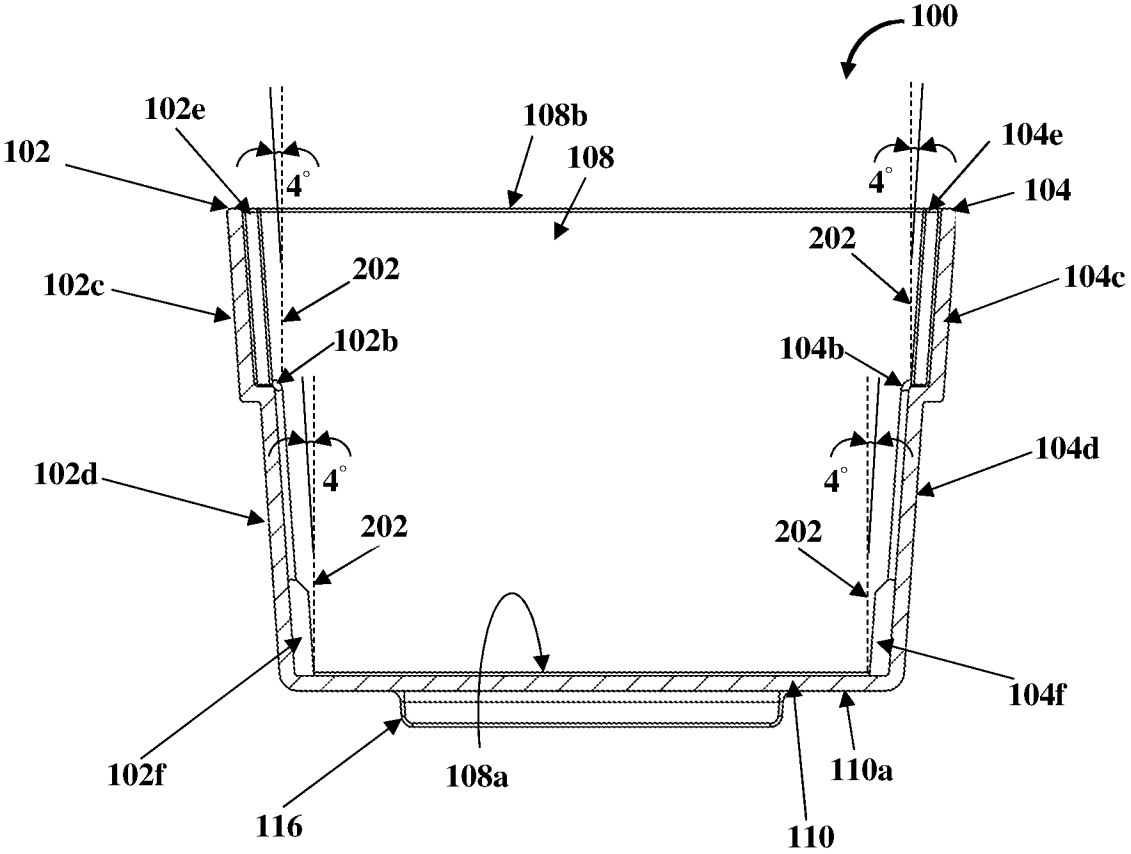
FIG. 2B exemplarily illustrates a cross-sectional view of the embodiment of the anti-dropping storage drawer shown in FIG. 1A, taken along a section B-B' shown in FIG. 2A.

FIG. 2B exemplarily illustrates a cross-sectional view of the embodiment of the anti-dropping storage drawer 100 shown in FIG. 1A, taken along a section B-B' shown in FIG. 2A. In an embodiment, the pair of side walls 102 and 104, the front wall 106, and the rear wall 108 of the anti-dropping storage drawer 100 taper outward towards an opening 112*a* of the cavity 112 as exemplarily illustrated in FIGS. 1A-1B. In an embodiment, the side walls 102 and 104 are inclined from a vertical plane 202 by an angle of, for example, about 4 degrees, as exemplarily illustrated in FIG. 2B. In another embodiment, the front wall 106 and the rear wall 108 are inclined from a vertical plane 202 by an angle of, for example, about 4 degrees, as exemplarily illustrated in FIG. 9C. In an embodiment, each of the ribs 116 of the anti-dropping storage drawer 100 is about $3/4^{th}$ the width of the base portion 110 as exemplarily illustrated in FIG. 2B and FIG. 4. In an embodiment, each of the ribs 116 extends along a width of the anti-dropping storage drawer 100 between the pair of side walls 102 and 104.

Figure 3:
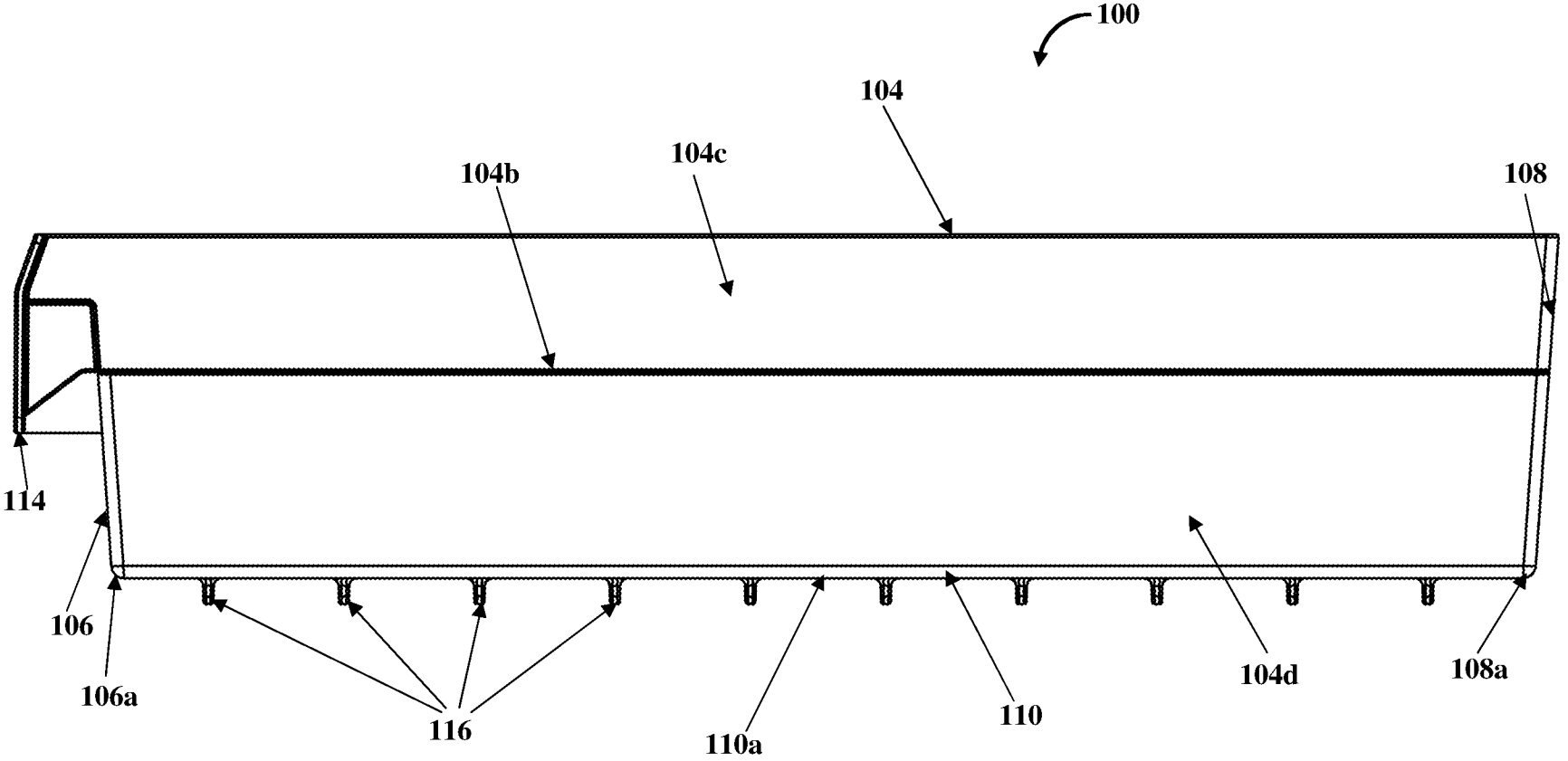
FIG. 3 exemplarily illustrates a right-side elevation view of the embodiment of the anti-dropping storage drawer shown in FIG. 1A.

FIG. 3 exemplarily illustrates a right-side elevation view of the embodiment of the anti-dropping storage drawer 100 shown in FIG. 1A. The right-side elevation view shows the side wall 104 extending between the front wall 106 and the rear wall 108. The right-side elevation view also shows the downwardly extending lip 114 of the front wall 106 and the ribs 116 projecting downward and substantially perpendicular to the underside 110*a* of the base portion 110.

Figure 4:
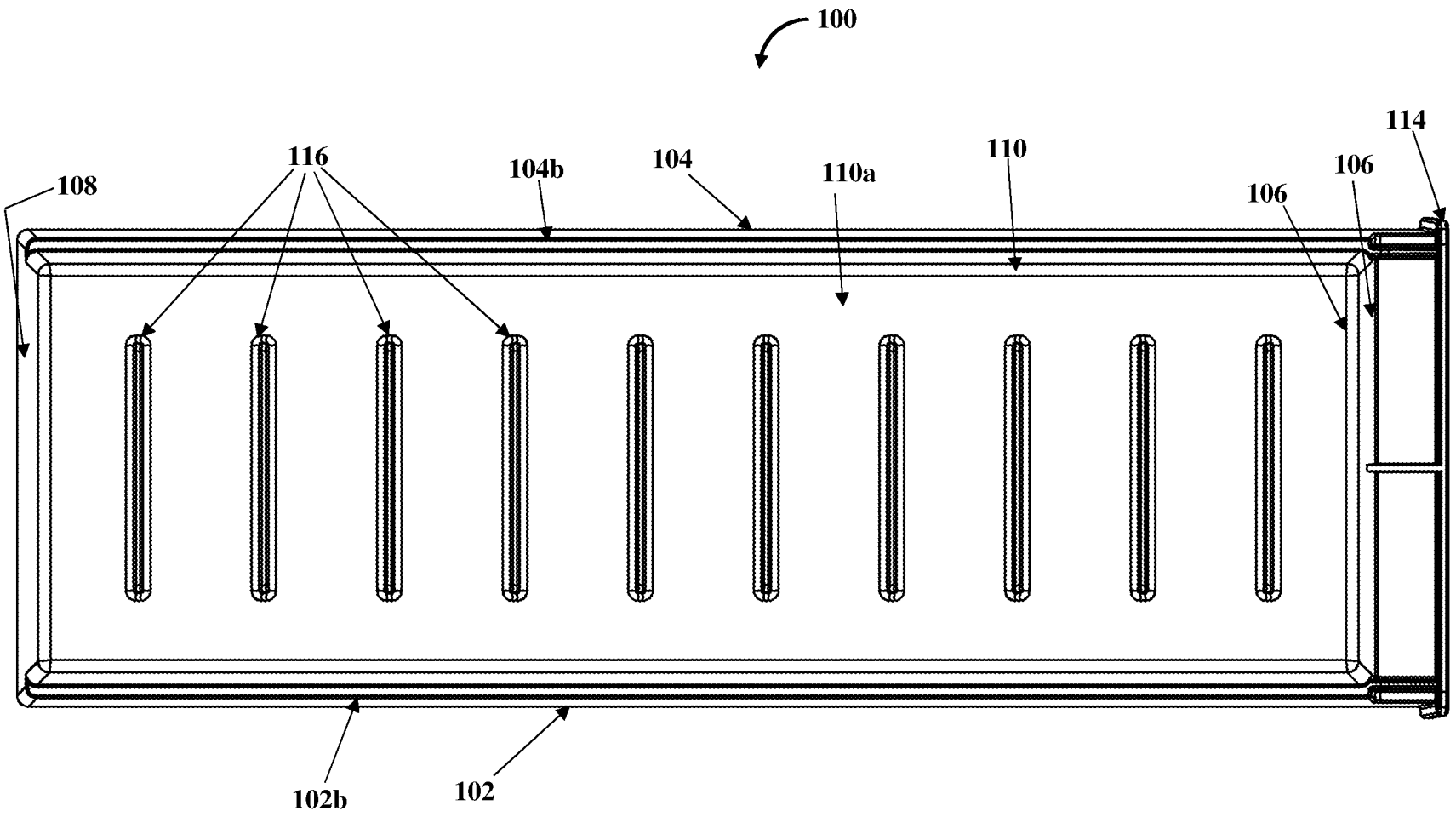
FIG. 4 exemplarily illustrates a bottom elevation view of the embodiment of the anti-dropping storage drawer shown in FIG. 1A.

FIG. 4 exemplarily illustrates a bottom elevation view of the embodiment of the anti-dropping storage drawer 100 shown in FIG. 1A. As exemplarily illustrated in FIG. 4, each of the ribs 116 extends along a width of the anti-dropping storage drawer 100 between the pair of side walls 102 and 104. FIG. 4 also exemplarily illustrates the ribs 116 spaced apart from each other and disposed substantially parallel to each other on the underside 110*a* of the base portion 110. As illustrated in FIG. 4, each of the ribs is configured to extend along a width of the anti-dropping storage drawer 100 between the pair of side walls 102 and 104. More specifically, each rib 116 extends along a straight line between the pair of side walls 102 and 104. Furthermore, each rib 116 is perpendicular to the pair of side walls 102 and 104, as shown in FIG. 4.

Figure 5:
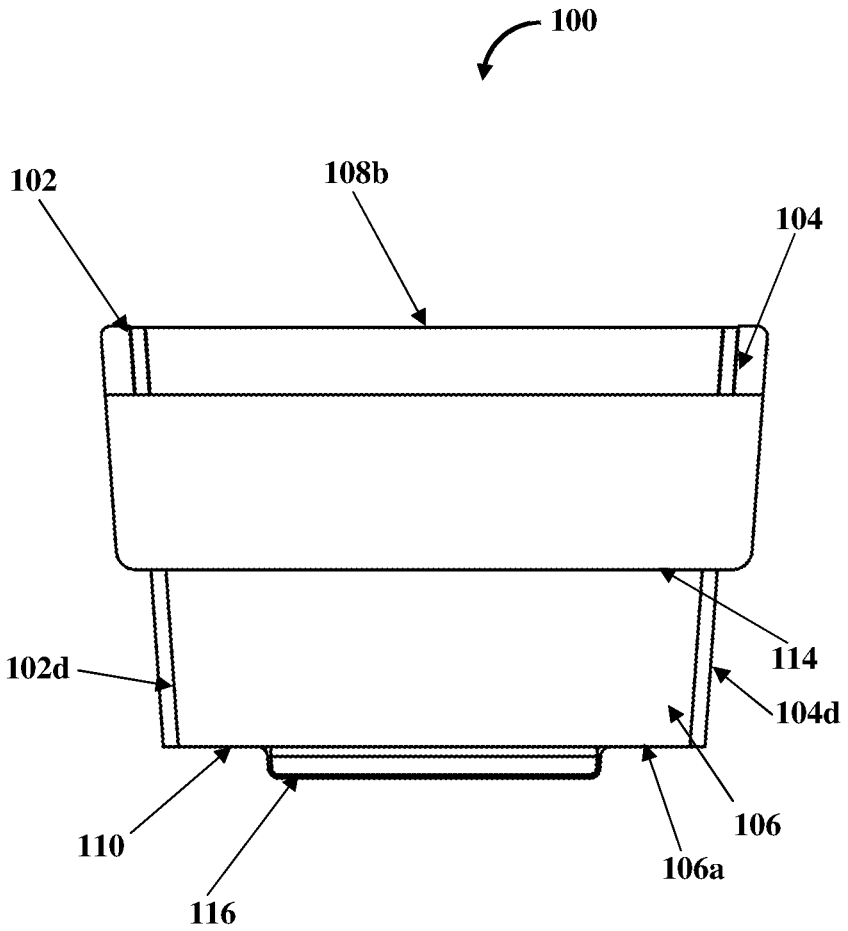
FIG. 5 exemplarily illustrates a front elevation view of the embodiment of the anti-dropping storage drawer shown in FIG. 1A.

FIG. 5 exemplarily illustrates a front elevation view of the embodiment of the anti-dropping storage drawer 100 shown in FIG. 1A. The material used for manufacturing the anti-dropping storage drawer 100 comprises, for example, polypropylene. In an embodiment, exemplary dimensions of the anti-dropping storage drawer 100 are as follows. The anti-dropping storage drawer 100 has a length of about 11.4 inches and a width of about 3.8 inches; a height of about 2.51 inches, excluding the ribs 116; and a height of about 2.7 inches, including the ribs 116. The width of the downwardly extending lip 114 of the front wall 106 is about 3.98 inches. The thickness of each of the side walls 102 and 104 is about 0.075 inches. The length of the opening 112*a* of the cavity 112 exemplarily illustrated in FIGS. 1A-1B, that is, the distance between the top 106*b* of the front wall 106 and the top 108*b* of the rear wall 108 is about 10.36 inches. The underside 110*a* of the base portion 110 has a length of about 10.51 inches. Each of the ribs 116 has a width of about 2 inches, a height of about 0.19 inch, and a thickness of about 0.1 inch to about 0.2 inch.

Figure 6:
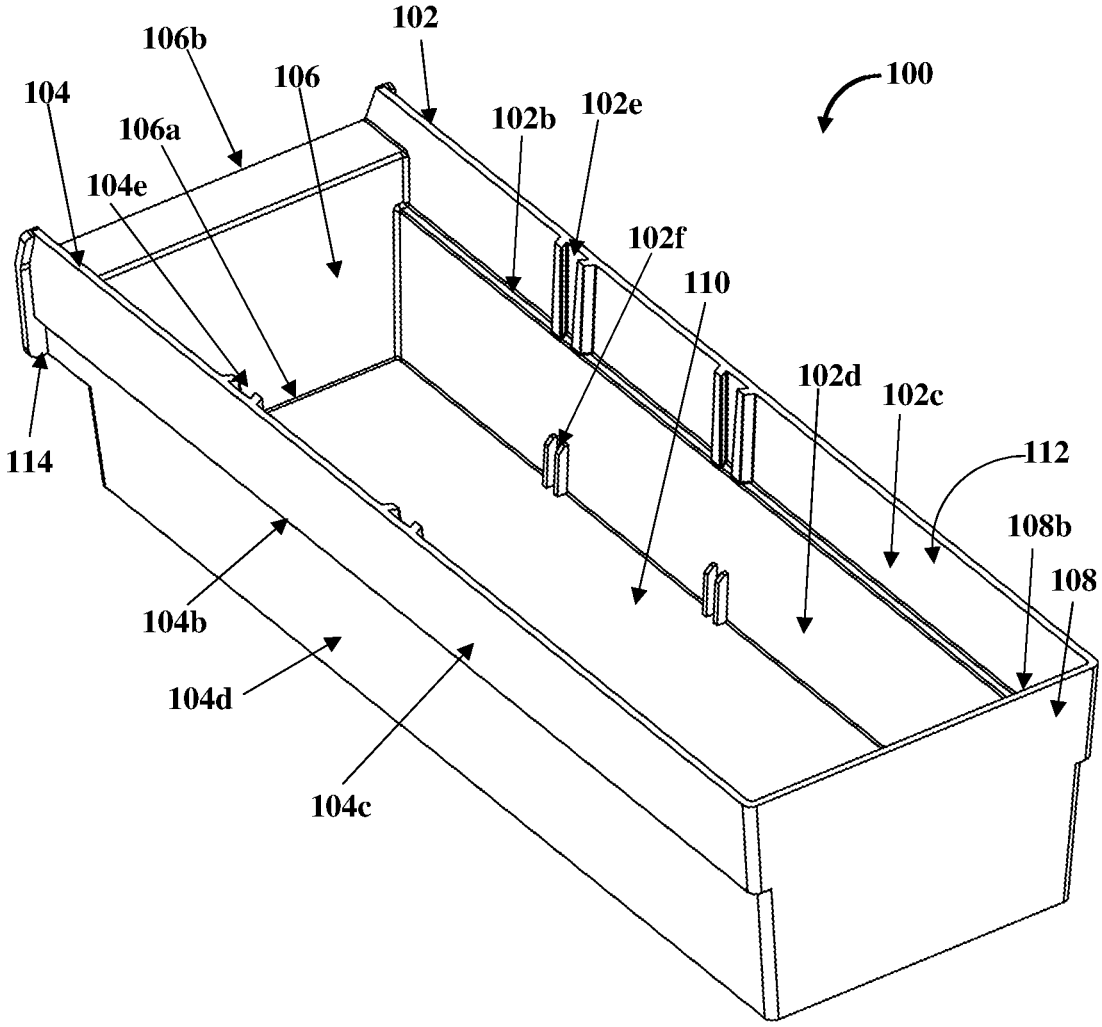
FIG. 6 exemplarily illustrates a top, rear perspective view of the embodiment of the anti-dropping storage drawer shown in FIG. 1A.

FIG. 6 exemplarily illustrates a top, rear perspective view of the embodiment of the anti-dropping storage drawer 100 shown in FIG. 1A. In an embodiment as exemplarily illustrated in FIG. 6 and in FIGS. 1A-1B, FIG. 5, FIG. 7, and FIG. 9C, the height of the front wall 106 is less than the height of the side walls 102 and 104 and the rear wall 108. In an embodiment, the top edge 106*b* of the front wall 106 is lower than the top edge 108*b* of the rear wall 108. In an embodiment, the height of the front wall 106 is, for example, about 0.2 inch to about 0.5 inch less than the height of the side walls 102 and 104 and the rear wall 108. As exemplarily illustrated in FIGS. 1A-3, FIGS. 5, and 9C, the height of the side walls 102 and 104 is equal to the height of the rear wall 108. The height of the side walls 102 and 104 and the rear wall 108 is equal to the height of the anti-dropping storage drawer 100, excluding the ribs 116. FIG. 6 also shows the ledge 102*b* extending along the length of the side wall 102 as disclosed in the description of FIG. 9A.

Figure 8:
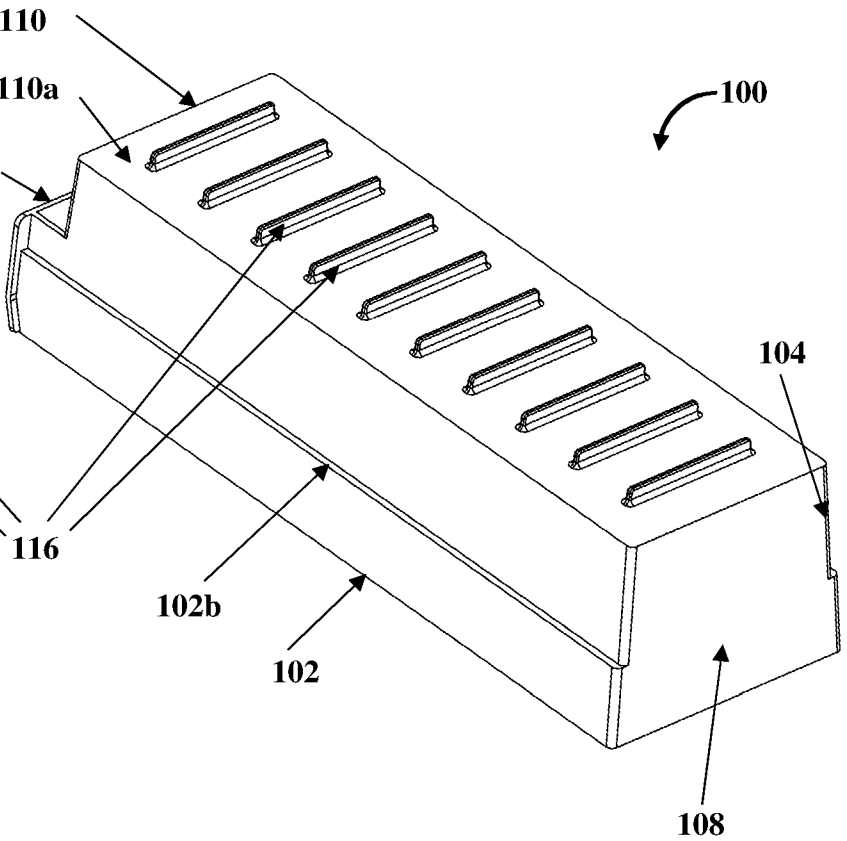
FIG. 8 exemplarily illustrates a rear, bottom perspective view of the embodiment of the anti-dropping storage drawer shown in FIG. 1A.
Figure 7:
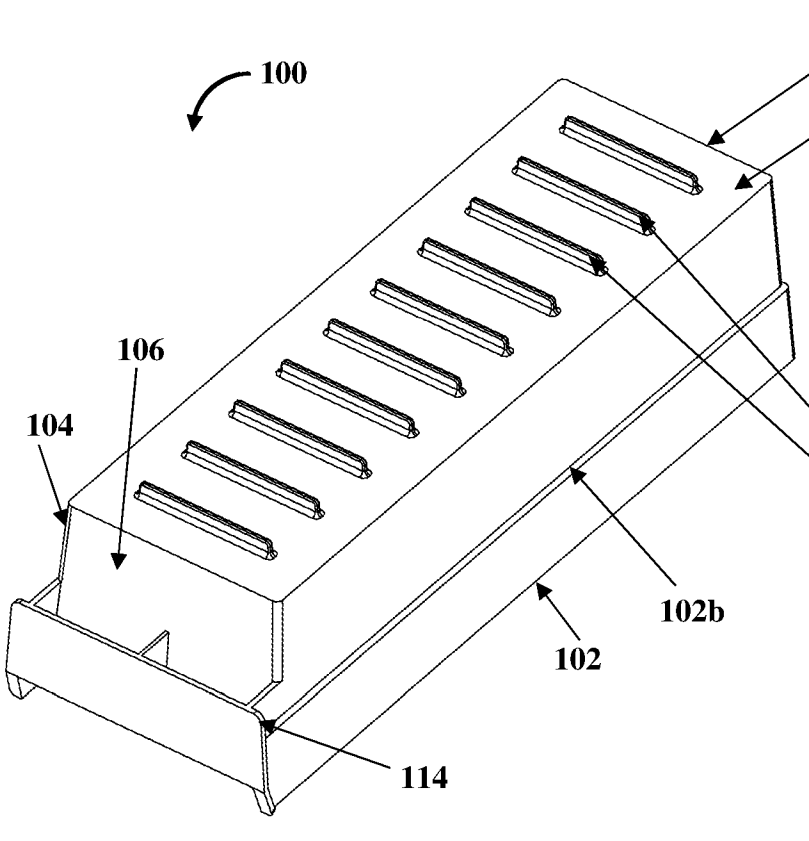
FIG. 7 exemplarily illustrates a front, bottom perspective view of the embodiment of the anti-dropping storage drawer shown in FIG. 1A.

FIG. 7 and FIG. 8 exemplarily illustrate a front, bottom perspective view and a rear, bottom perspective view, respectively, of the embodiment of the anti-dropping storage drawer 100 shown in FIG. 1A. As exemplarily illustrated in FIG. 7 and FIG. 8, the anti-dropping storage drawer 100 comprises about ten (10) ribs 116. Each rib 116 is disposed, for example, about one (1) inch, apart from an adjacent rib 116. In an embodiment, the spacing between adjacent ribs 116 is more than one (1) inch. In another embodiment, the spacing between adjacent ribs 116 is less than one (1) inch. In an embodiment, the number of ribs 116 depends on the length of the anti-dropping storage drawer 100. For example, a longer, anti-dropping storage drawer 100 comprises more ribs 116 compared to the number of ribs in a shorter, anti-dropping storage drawer 100.

Figure 9A:
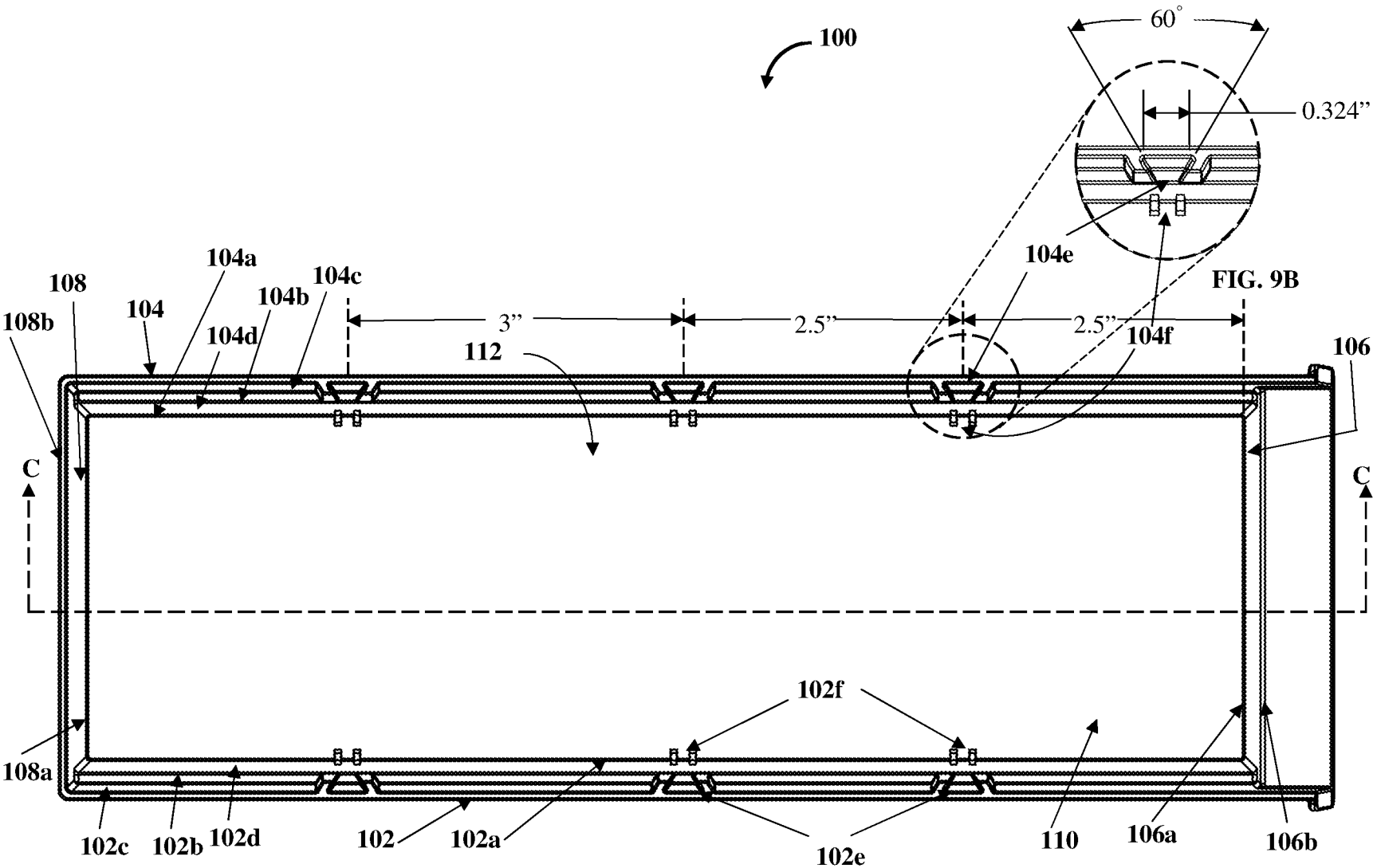
FIG. 9A exemplarily illustrates a top plan view of the embodiment of the anti-dropping storage drawer shown in FIG. 1A.

FIG. 9A exemplarily illustrates a top plan view of the embodiment of the anti-dropping storage drawer 100 shown in FIG. 1A. As exemplarily illustrated in FIG. 9A and in FIGS. 1A-4, FIGS. 6-8, and FIG. 9B-9C, the side walls 102 and 104 comprise ledges 102*b* and 104*b*, respectively, extending along a length of each of the side walls 102 and 104. The ledges 102*b* and 104*b* are located proximal to respective mid-sections of the side walls 102 and 104, respectively. The ledges 102*b* and 104*b* are configured to separate the side walls 102 and 104, respectively, into separate sections. For example, the ledge 102*b* on the side wall 102 separates the side wall 102 into an upper section 102*c* and a lower section 102*d* as exemplarily illustrated in FIG. 1A, FIGS. 2A-2B, FIG. 6, and FIG. 9A, and the ledge 104*b* on the side wall 104 separates the side wall 104 into an upper section 104*c* and a lower section 104*d* as exemplarily illustrated in FIG. 1B, FIG. 2B, FIG. 3, FIG. 9A, and FIG. 9C. The ledges 102*b* and 104*b* are configured to project outwards from tops of the lower sections 102*d* and 104*d* of the side walls 102 and 104, respectively. The upper sections 102*c* and 104*c* of the side walls 102 and 104, respectively, are configured to extend upwards from edges of the ledges 102*b* and 104*b* of the side walls 102 and 104, respectively.

In an embodiment, the anti-dropping storage drawer 100 further comprises divider slots 102*e* and 104*e* disposed on the inner surfaces of the upper sections 102*c* and 104*c* of the side walls 102 and 104, respectively. In an embodiment, the anti-dropping storage drawer 100 further comprises divider slots 102*f* and 104*f* disposed on the inner surfaces of the lower sections 102*d* and 104*d* of the side walls 102 and 104, respectively. The spacing between two adjacent divider slots 102*e* on the upper section 102*c* of the side wall 102 and between two adjacent divider slots 104*e* on the upper section 104*c* of the side wall 104 ranges, for example, from about 2.5 inches to about 3 inches. Similarly, the spacing between two adjacent divider slots 102*f* on the lower section 102*d* of the side wall 102 and between two adjacent divider slots 104*f* on the lower section 104*d* of the side wall 104 ranges, for example, from about 2.5 inches to about 3 inches. In an embodiment, the divider slots 102*e* and 104*e* disposed on the inner surfaces of the upper sections 102*c* and 104*c* of the side walls 102 and 104 are aligned with corresponding divider slots 102*f* and 104*f* disposed on the inner surfaces of the lower sections 102*d* and 104*d* of the side walls 102 and 104, respectively. Furthermore, the divider slots 102*e* disposed on the inner surfaces of the upper section 102*c* of the side wall 102 are aligned opposite to the divider slots 104*e* disposed on the inner surfaces of the upper section 104*c* of the side wall 104 as exemplarily illustrated in FIG. 9A. Similarly, the divider slots 102*f* disposed on the inner surfaces of the lower section 102*d* of the side wall 102 are aligned opposite to the divider slots 104*f* disposed on the inner surfaces of the lower section 104*d* of the side wall 104 as exemplarily illustrated in FIG. 9A. The divider slots 102*e*, 102*f* and 104*e*, 104*f* on the pair of side walls 102 and 104, respectively, are configured to accommodate dividers 1002 exemplarily illustrated in FIG. 10A, within the cavity 112 of the anti-dropping storage drawer 100 for dividing the cavity 112 into smaller compartments (not shown) in the anti-dropping storage drawer 100.

FIG. 9B exemplarily illustrates an enlarged view of a divider slot 104*e* disposed on an inner surface of an upper section 104*c* of the side wall 104 of the anti-dropping storage drawer 100 shown in FIG. 1A, and a divider slot 104*f* disposed on an inner surface of a lower section 104*d* of the side wall 104. An angle defined by the divider slot 104*e* is, for example, about 60 degrees, as exemplarily illustrated in FIG. 9B.

Figure 9C:
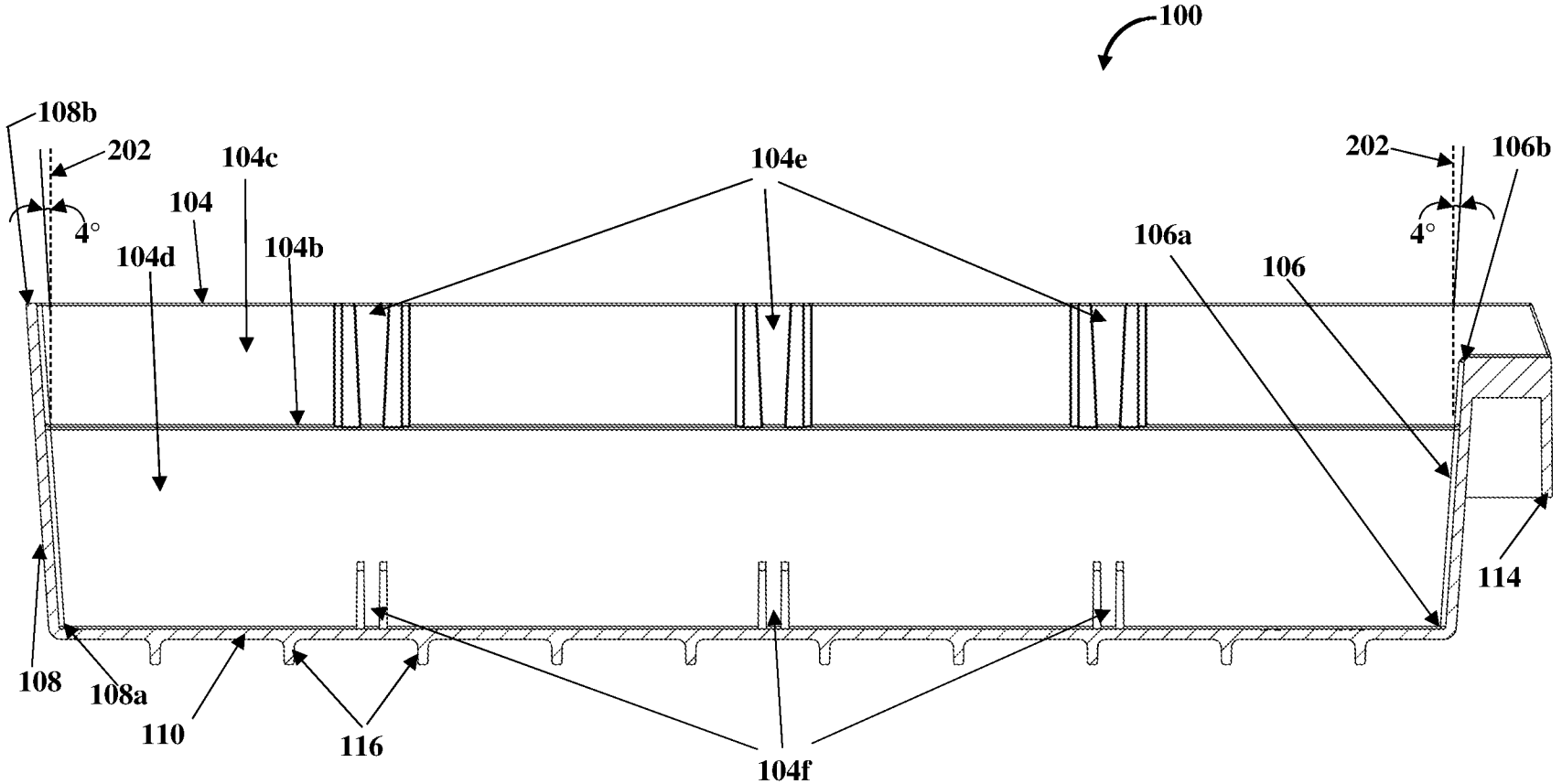
FIG. 9C exemplarily illustrates a cross-sectional view of the embodiment of the anti-dropping storage drawer shown in FIG. 1A, taken along a section C-C' shown in FIG. 9A.

FIG. 9C exemplarily illustrates a cross-sectional view of the embodiment of the anti-dropping storage drawer 100 shown in FIG. 1A, taken along a section C-C' shown in FIG. 9A. As exemplarily illustrated in FIG. 9C, the anti-dropping storage drawer 100 comprises multiple divider slots 104*e* and 104*f* substantially evenly distributed along a length of the anti-dropping storage drawer 100.

Figure 10A:
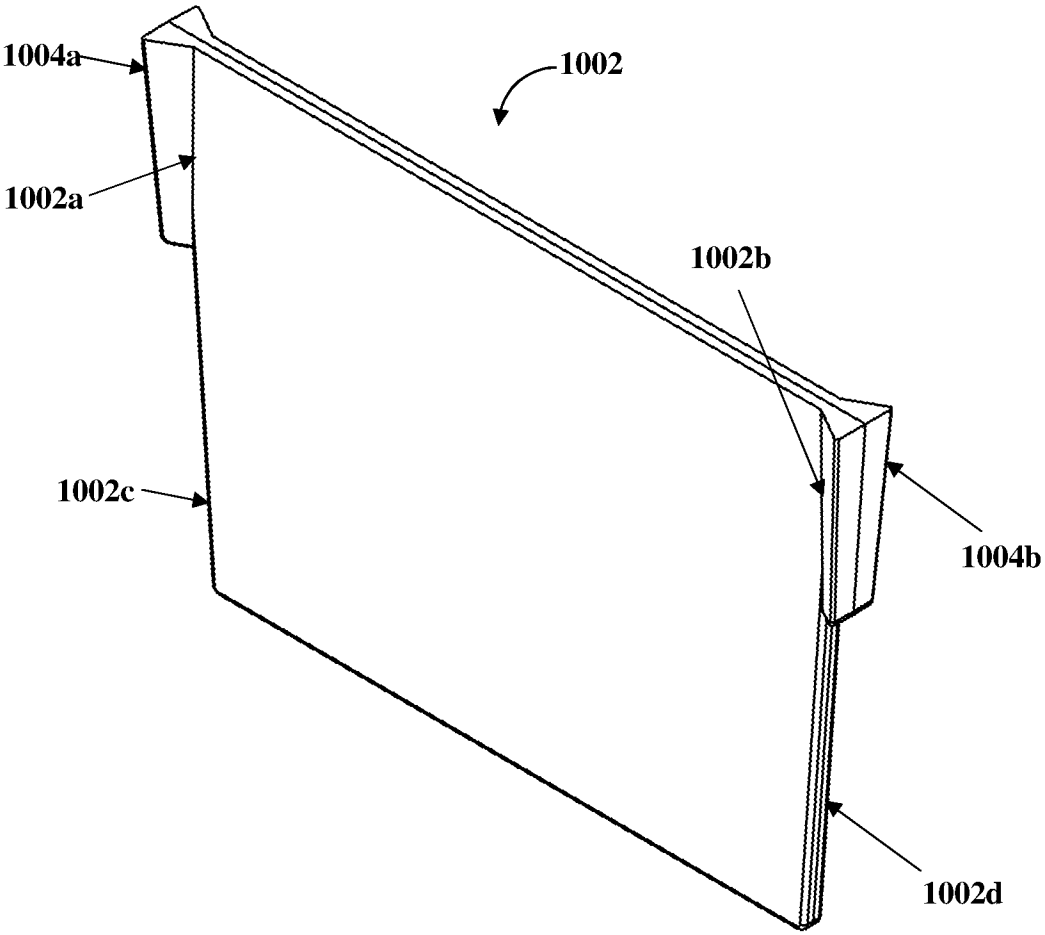
FIG. 10A exemplarily illustrates a front, right-side perspective view of an embodiment of a divider configured to divide a cavity of the anti-dropping storage drawer into smaller compartments.
Figure 10B:
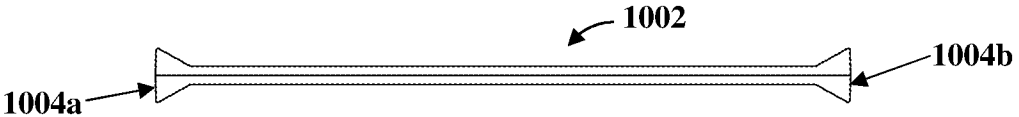
FIG. 10B exemplarily illustrates a top plan view of the embodiment of the divider shown in FIG. 10A.
Figure 10C:
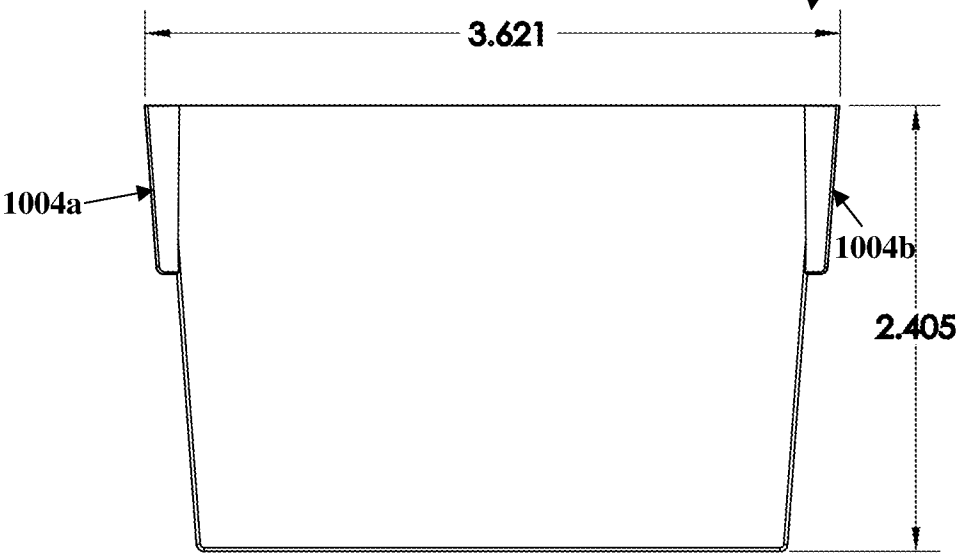
FIG. 10C exemplarily illustrates a front elevation view of the embodiment of the divider shown in FIG. 10A.
Figure 10D:
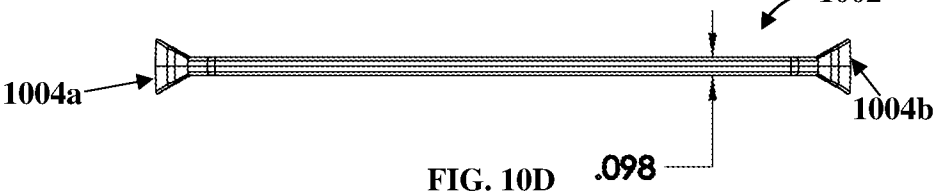
FIG. 10D exemplarily illustrates a bottom elevation view of the embodiment of the divider shown in FIG. 10A FIG. 10E exemplarily illustrates a right-side elevation view of the embodiment of the divider shown in FIG. 10A, where the left-side elevation view is a mirror image of the right-side elevation view of the divider.
Figure 10E:
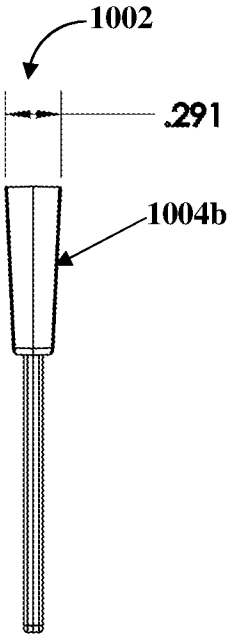

FIG. 10A exemplarily illustrates a front, right-side perspective view of an embodiment of a divider 1002 configured to divide the cavity 112 of the anti-dropping storage drawer 100 shown in FIGS. 1A-1B, into smaller compartments (not shown). The divider 1002 has a trapezoidal shape. In an embodiment, the divider 1002 has the shape of an isosceles trapezoid. The material used for manufacturing the divider 1002 comprises, for example, polypropylene. The divider 1002 comprises wedge-shaped extensions 1004*a* and 1004*b*. Leading edges of the wedge-shaped extensions 1004*a* and 1004*b* are attached to the upper sides 1002*a* and 1002*b* of the divider 1002, respectively, causing the wedge-shaped extensions 1004*a* and 1004*b* to extend laterally from the upper sides 1002*a* and 1002*b* of the divider 1002. To create a partition in the cavity 112 of the anti-dropping storage drawer 100, lower sides 1002*c* and 1002*d* of the divider 1002 are inserted into the divider slots 102*f* and 104*f* disposed on the inner surfaces of the lower sections 102*d* and 104*d* of the pair of side walls 102 and 104, respectively, and the wedge-shaped extensions 1004*a* and 1004*b* of the divider 1002 are inserted into the divider slots 102*e* and 104*e* disposed on the inner surfaces of the upper sections 102*c* and 104*c* of the side walls 102 and 104, respectively. FIG. 10B exemplarily illustrates a top plan view of the embodiment of the divider 1002 shown in FIG. 10A. FIG. 10C exemplarily illustrates a front elevation view of the embodiment of the divider 1002 shown in FIG. 10A. FIG. 10D exemplarily illustrates a bottom elevation view of the embodiment of the divider 1002 shown in FIG. 10A. FIG. 10E exemplarily illustrates a right-side elevation view of the embodiment of the divider 1002 shown in FIG. 10A. The left-side elevation view is a mirror image of the right-side elevation view of the divider 1002. As exemplarily illustrated in FIGS. 10C-10E, in an embodiment, the divider 1002 has a width of about 3.621 inches, a height of about 2.405 inches, a thickness of about inch at the wedge-shaped extensions 1004*a* and 1004*b*, and a thickness of about inch at any of its portions, excluding the portions having the wedge-shaped extensions 1004*a* and 1004*b*.

Figure 11A:
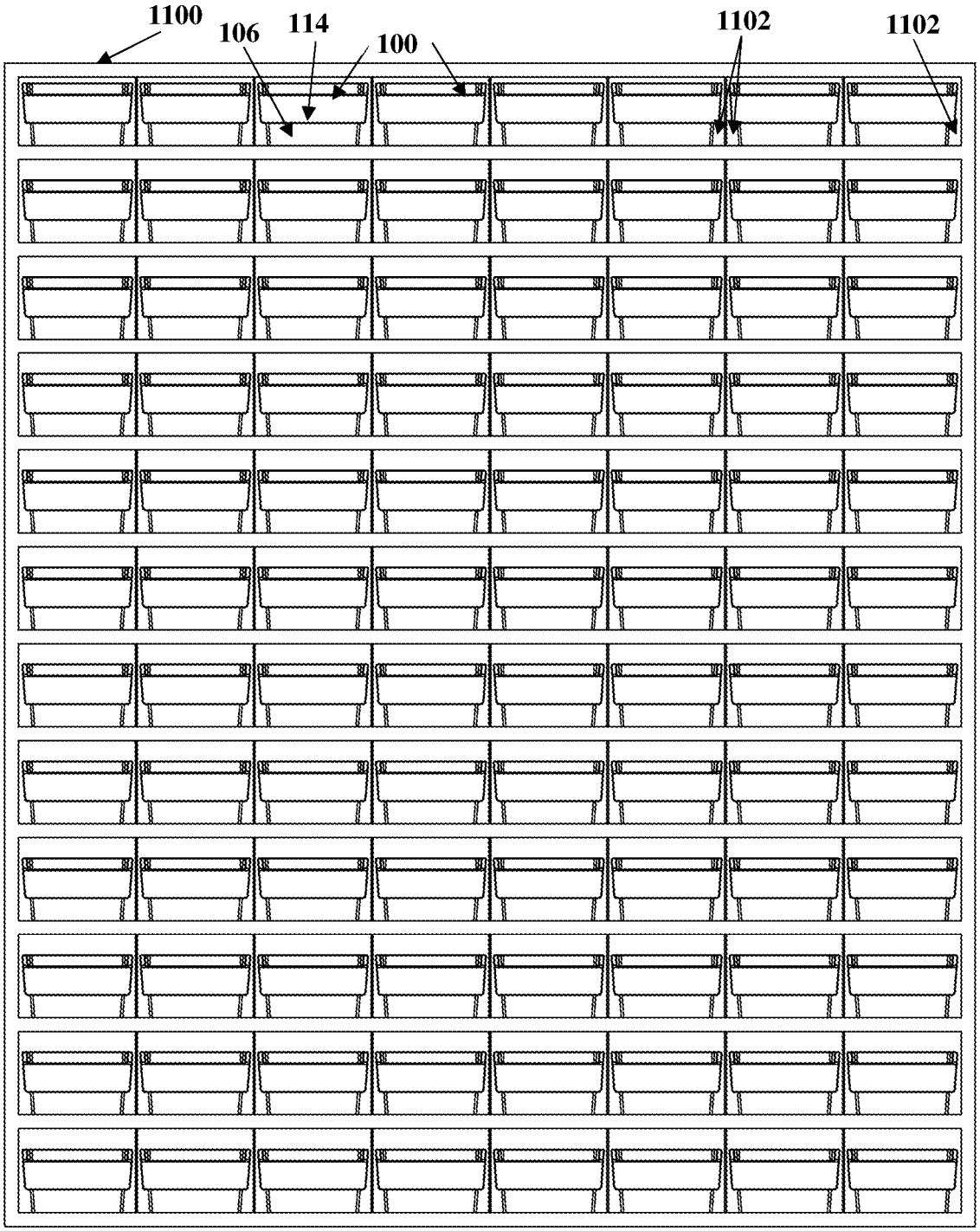
FIG. 11A exemplarily illustrates a front elevation view of a drawer unit comprising multiple anti-dropping storage drawers shown in FIG. 1A.
Figure 11B:
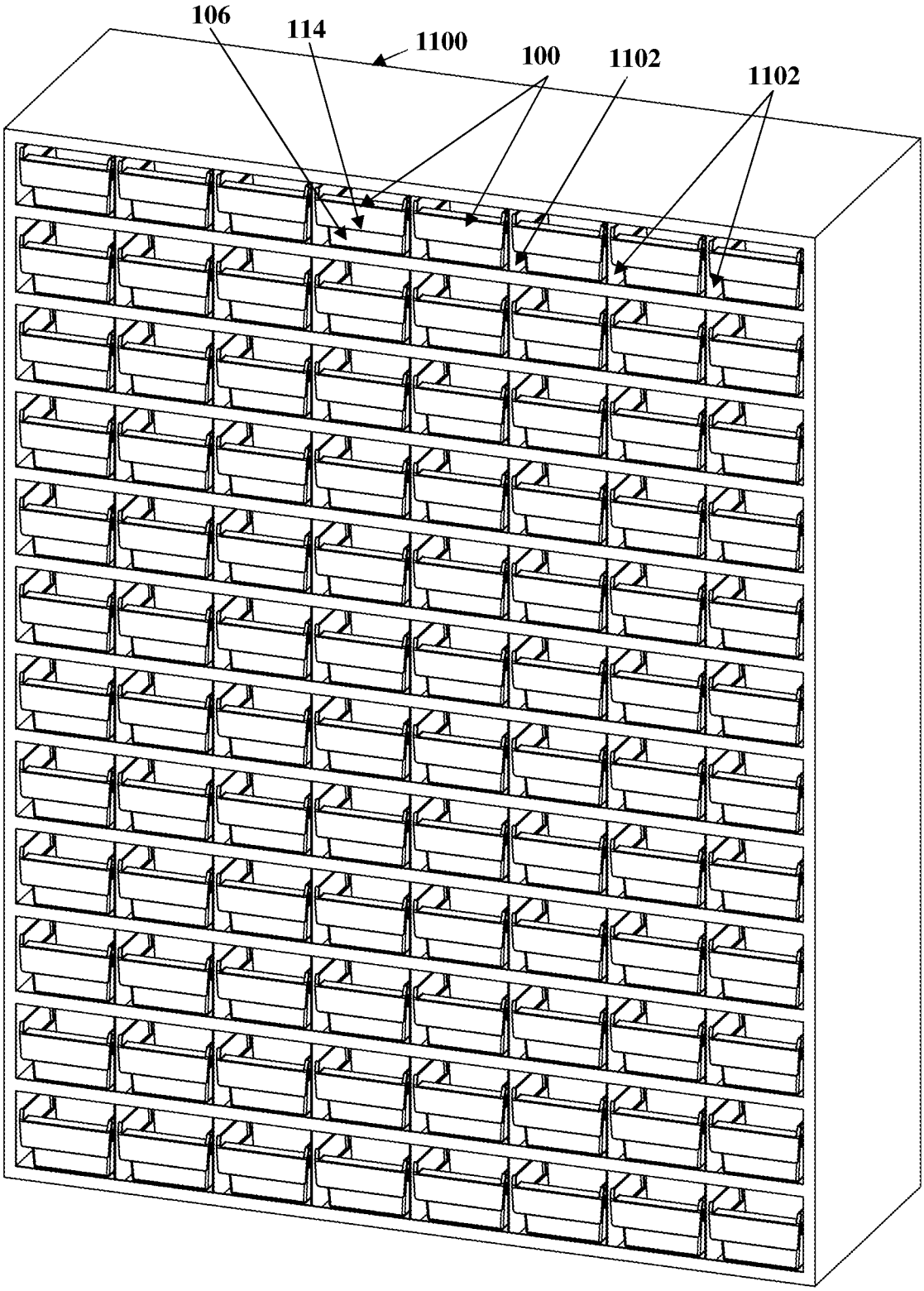
FIG. 11B exemplarily illustrates a front, right-side perspective view of the drawer unit shown in FIG. 11A.

FIG. 11A exemplarily illustrates a front elevation view of a drawer unit 1100 comprising multiple anti-dropping storage drawers 100 shown in FIG. 1A. FIG. 11B exemplarily illustrates a front, right-side perspective view of the drawer unit 1100 shown in FIG. 11A. The drawer unit 1100 is a storage unit configured, for example, as a bin rack assembly. The drawer unit 1100 comprises multiple slots 1102 for accommodating the anti-dropping storage drawers 100. As exemplarily illustrated in FIGS. 11A-11B, all the anti-dropping storage drawers 100 are accommodated in their respective slots 1102 in a stored position. A user may grip the downwardly extending lip 114 of the front wall 106 of each anti-dropping storage drawer 100 to slide and pull the anti-dropping storage drawer 100 out of its slot 1102 and access the contents of the anti-dropping storage drawers 100.

Figure 12A:
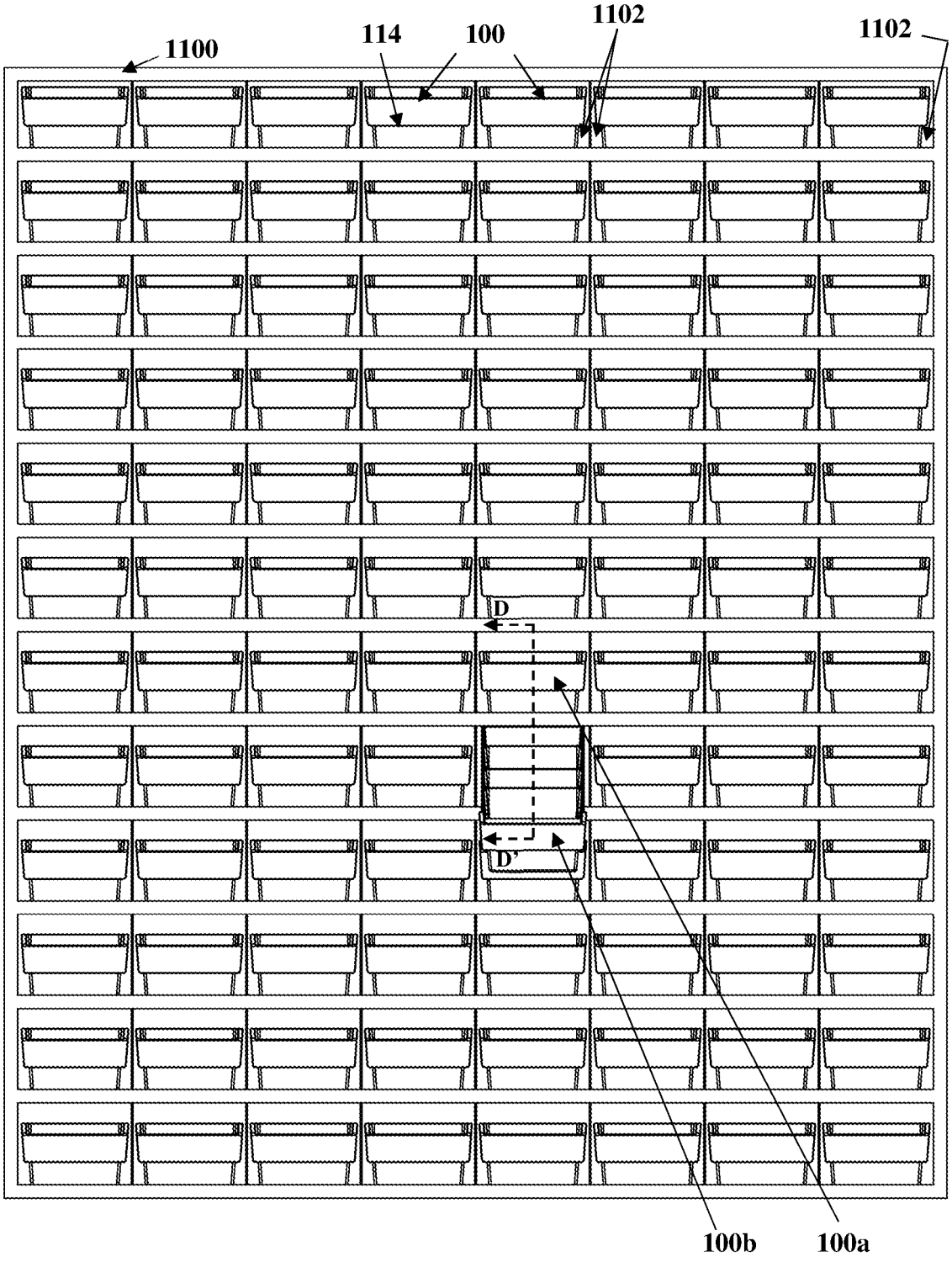
FIG. 12A exemplarily illustrates a front elevation view of the drawer unit shown in FIG. 11A, with one of the anti-dropping storage drawers pulled out by more than about half the length of the anti-dropping storage drawer.
Figure 12B:
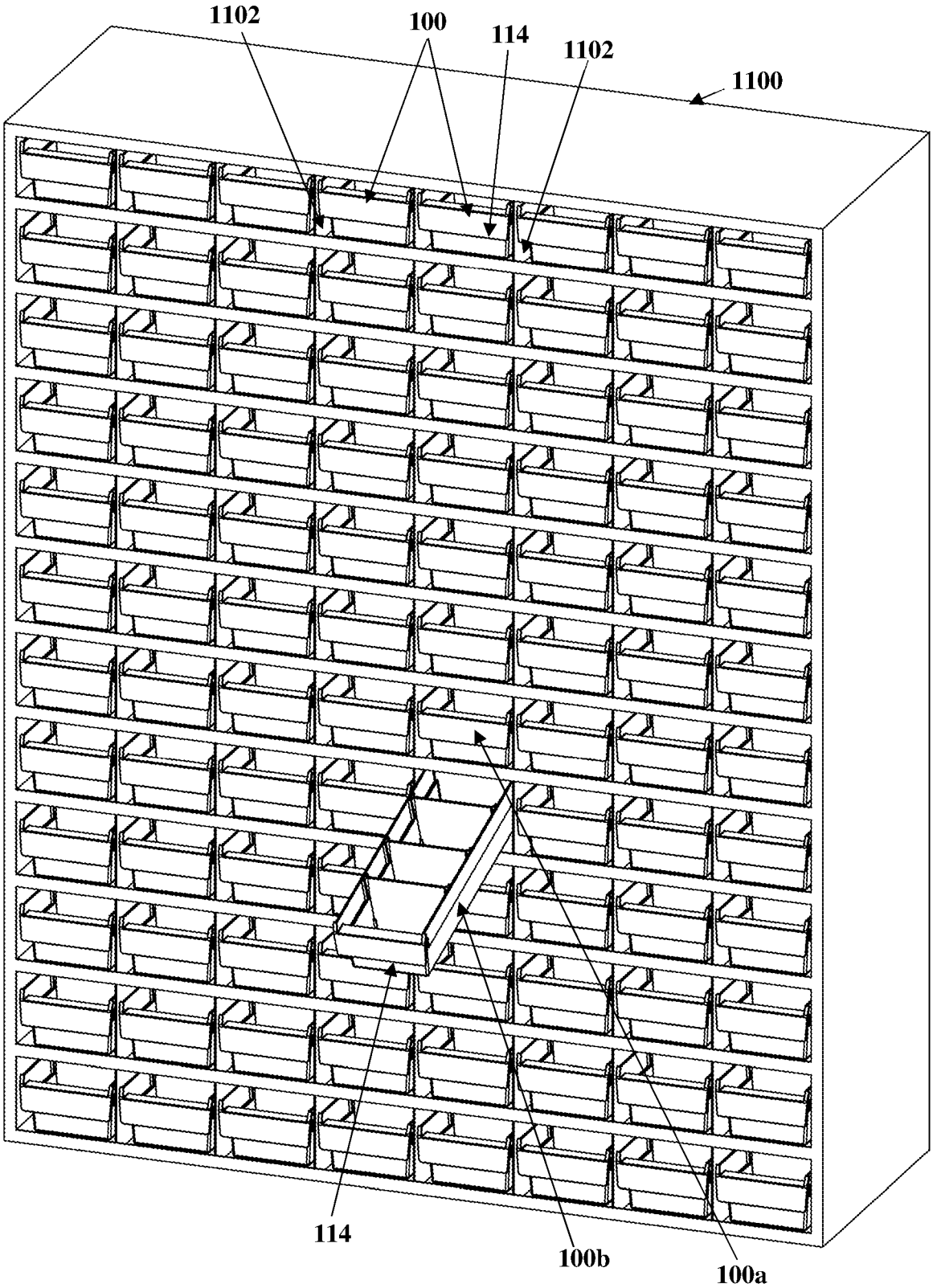
FIG. 12B exemplarily illustrates a front, right-side perspective view of the drawer unit and the pulled out anti-dropping storage drawer shown in FIG. 12A.

FIG. 12A exemplarily illustrates a front elevation view of the drawer unit 1100 shown in FIG. 11A, with one of the anti-dropping storage drawers 100*b* pulled out by more than about half the length of the anti-dropping storage drawer 100*b*. FIG. 12B exemplarily illustrates a front, right-side perspective view of the drawer unit 1100 and the pulled out anti-dropping storage drawer 100*b* shown in FIG. 12A. Each anti-dropping storage drawer 100, 100*a*, 100*b*, etc., is configured to slide in and out of a slot 1102 in the drawer unit 1100 as exemplarily illustrated in FIGS. 11A-12D.

Figure 12C:
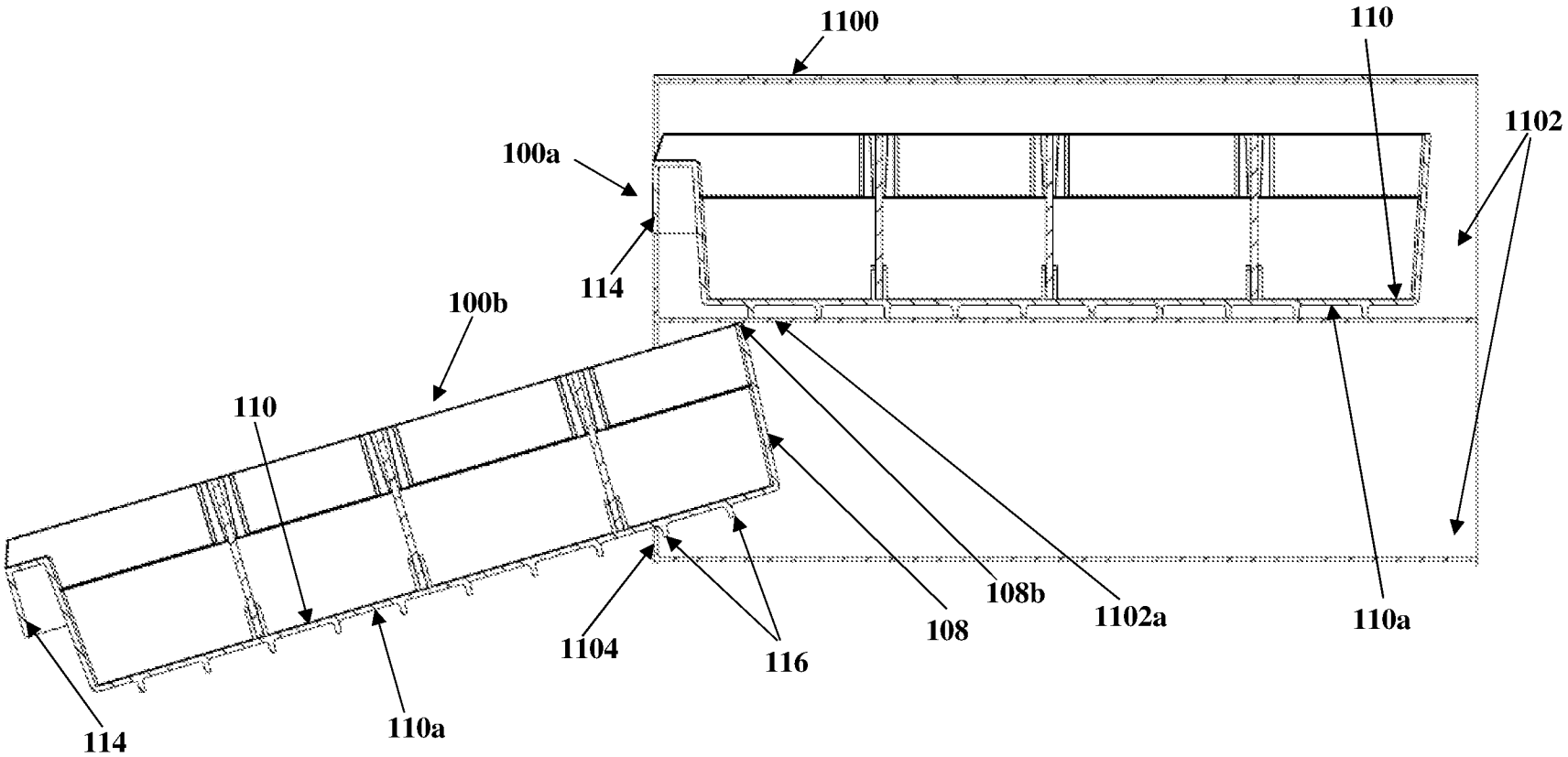
FIG. 12C exemplarily illustrates a cross-sectional view of a portion of the drawer unit and two anti-dropping storage drawers taken along a section D-D' shown in FIG. 12A, where the top anti-dropping storage drawer is in a stored position and the bottom anti-dropping storage drawer is pulled out by more than about half its length.
Figure 12D:
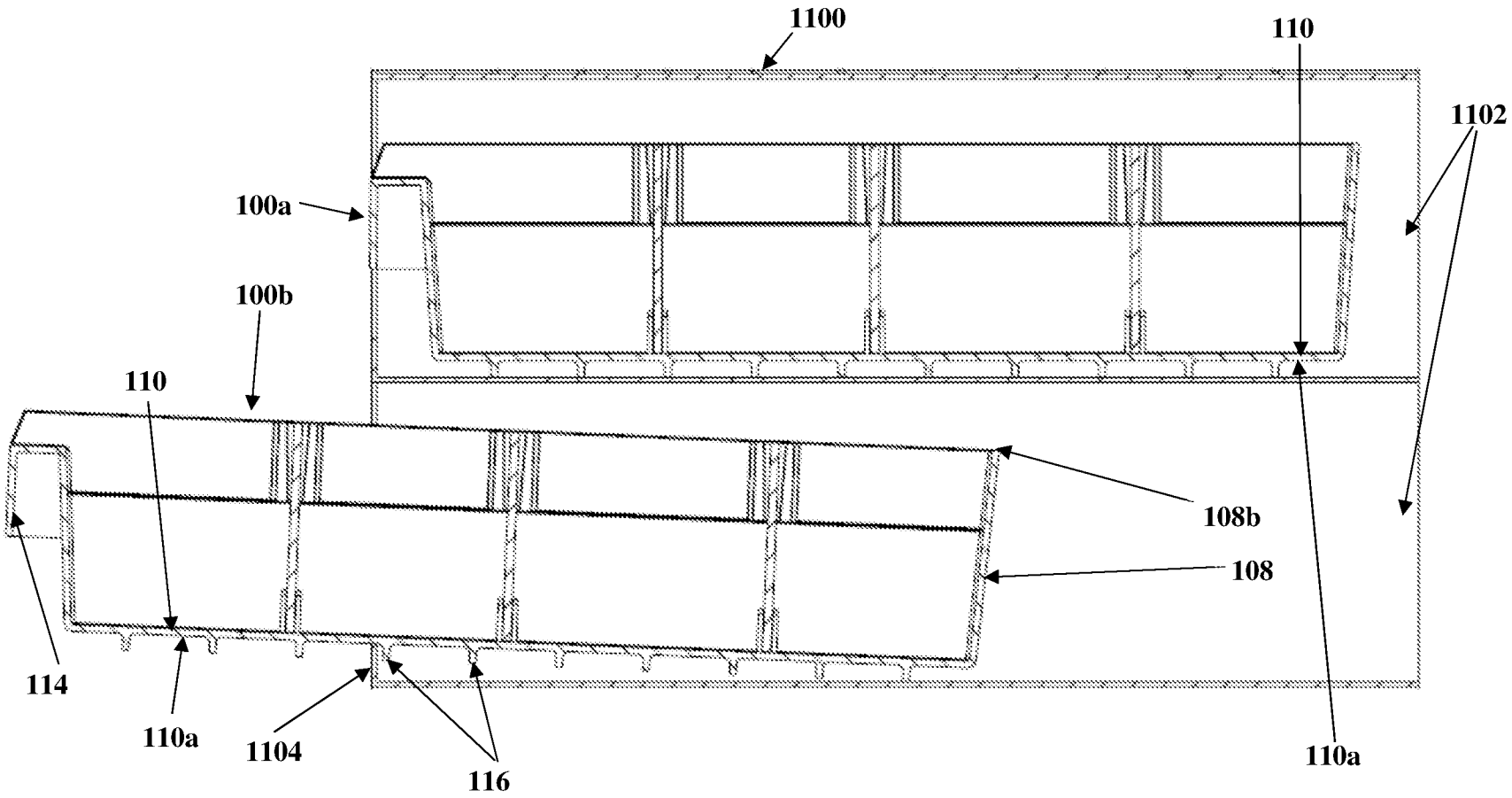
FIG. 12D exemplarily illustrates another cross-sectional view of a portion of the drawer unit and two anti-dropping storage drawers, where the top anti-dropping storage drawer is in a stored position and the bottom anti-dropping storage drawer is pulled out by less than about half its length.

FIG. 12C exemplarily illustrates a cross-sectional view of a portion of the drawer unit 1100 and two anti-dropping storage drawers 100*a* and 100*b* taken along a section D-D' shown in FIG. 12A, where the top anti-dropping storage drawer 100*a* is in a stored position and the bottom anti-dropping storage drawer 100*b* is pulled out by more than about half its length. FIG. 12D exemplarily illustrates another cross-sectional view of a portion of the drawer unit 1100 and two anti-dropping storage drawers 100*a* and 100*b*, where the top anti-dropping storage drawer 100*a* is in a stored position and the bottom anti-dropping storage drawer 100*b* is pulled out by less than about half its length. The height of the slots 1102 configured to accommodate the anti-dropping storage drawers 100*a* and 100*b* is, for example, about 3 inches. As exemplarily illustrated in FIGS. 12C and 12D, the ribs 116 on the underside 110*a* of the base portion 110 of the anti-dropping storage drawer 100*b* are configured to engage with a lower lip 1104 of the drawer unit 1100 when the anti-dropping storage drawer 100*b* is pulled out of the slot 1102 in the drawer unit 1100. When the anti-dropping storage drawer 100*b* is pulled out of the slot 1102 of the drawer unit 1100, and the anti-dropping storage drawer 100*b* tips downward or inclines forward with respect to a horizontal plane, for example, the horizontal plane of the anti-dropping storage drawer 100*b*, one of the ribs 116 blocks a forward and downward movement of the anti-dropping storage drawer 100*b* out of the drawer unit 1100 as exemplarily illustrated in FIG. 12C. Simultaneously, a top edge 108*b* of the rear wall 108 of the anti-dropping storage drawer 100*b* rests against a ceiling 1102*a* of the slot 1102 of the drawer unit 1100, thereby preventing the anti-dropping storage drawer 100*b* from tipping or dropping further downward with respect to the horizontal plane of the anti-dropping storage drawer 100*b* as exemplarily illustrated in FIG. 12C. Furthermore, by engaging with the lower lip 1104 of the drawer unit 1100, one of the ribs 116 of the anti-dropping storage drawer 100*b* prevents the anti-dropping storage drawer 100*b* from sliding out of its slot 1102 in the drawer unit 1100 and falling, for example, to the floor and/or on a user's feet, thereby preventing the anti-dropping storage drawer 100*b* from getting damaged and/or preventing injury to the user, while also protecting the contents of the anti-dropping storage drawer 100*b*.

FIG. 13 exemplarily illustrates an embodiment of the anti-dropping storage drawer 100 comprising chevron shaped ribs 1300. As shown in FIG. 13, the chevron shaped ribs 1300 form a v-shape along their length.

FIG. 14 exemplarily illustrates an embodiment of the anti-dropping storage drawer 100 comprising both chevron shaped ribs 1300 illustrated in FIG. 13, and ribs 116 that extend along a straight line as illustrated in FIGS. 2A-5, 7, 8, and 9C.

Figure 15:
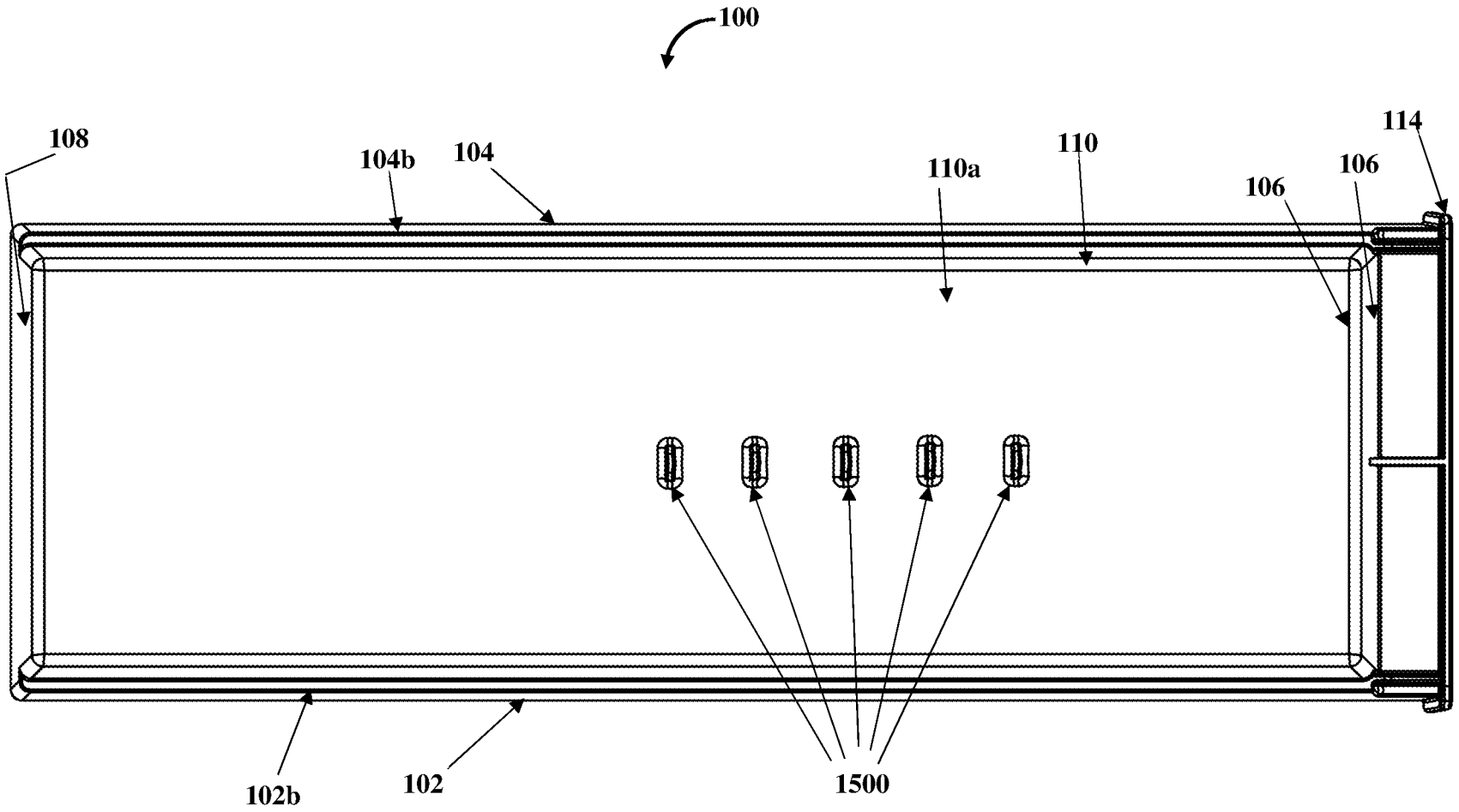
FIG. 15 exemplarily illustrates an embodiment of the anti-dropping storage drawer comprising ribs that have a shorter length compared to the ribs shown in FIGS. 2A-5, 7, 8, and 9C.

FIG. 15 exemplarily illustrates an embodiment of the anti-dropping storage drawer 100 comprising projections

1500 that have a shorter width compared to the ribs 116 shown in FIGS. 2A-5, 7, 8, and 9C. In an embodiment, the projections 1500 represent tabs or bumps projecting from the underside 110*a* of the base portion 110 of the anti-dropping storage drawer 100. In an embodiment, the tabs 1500 have a width of about 0.25 inch to 1 inch.

Figure 16:
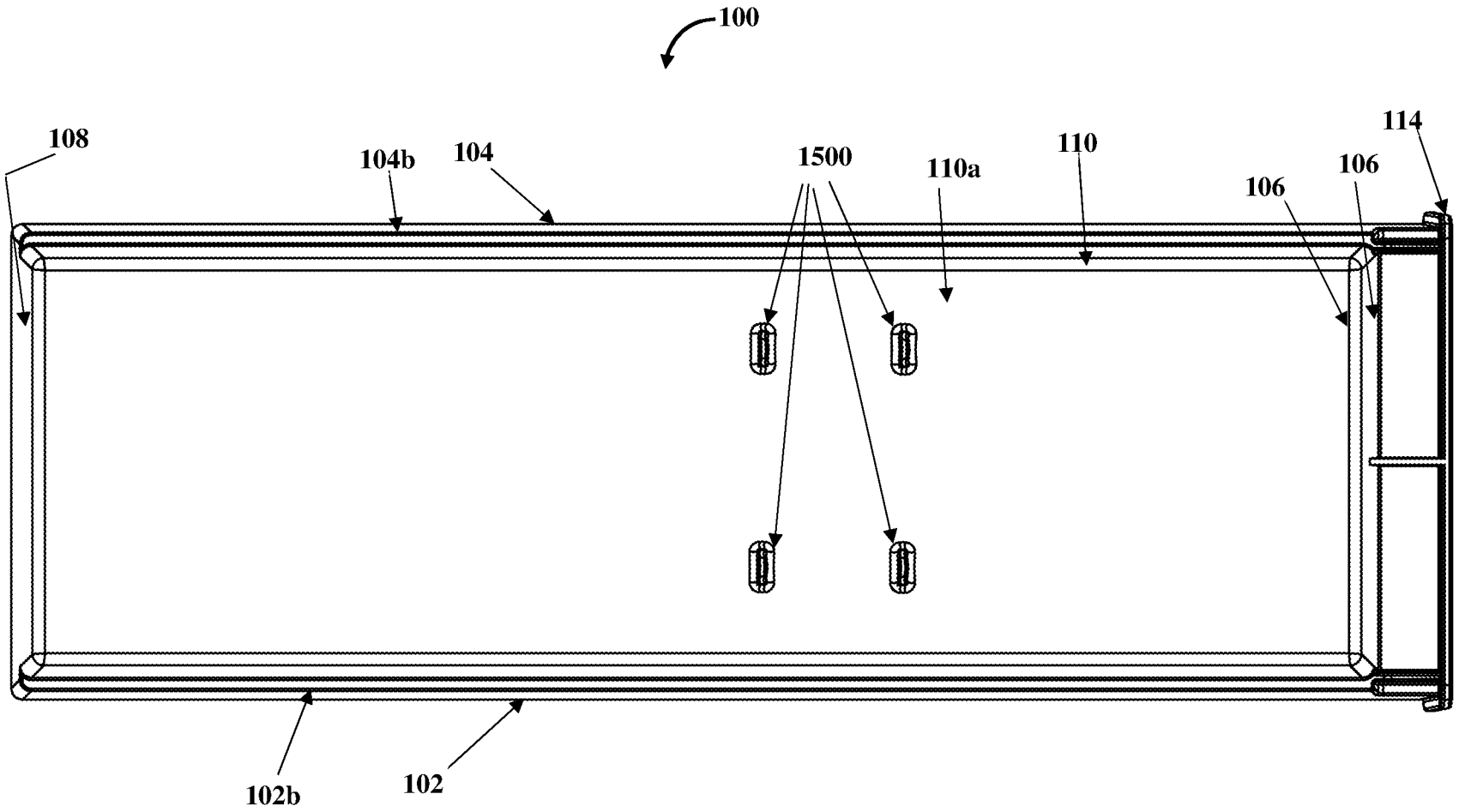
FIG. 16 exemplarily illustrates an embodiment of the anti-dropping storage drawer comprising rows of shorter ribs illustrated in FIG. 15, with each row comprising at least two shorter ribs.

FIG. 16 exemplarily illustrates an embodiment of the anti-dropping storage drawer 100 comprising rows of tabs 1500 illustrated in FIG. 15, with each row comprising at least two tabs 1500. Apart from the width and shape, the thickness and height of the chevron shaped ribs 1300 and tabs 1500 are same as the thickness and height of the ribs 116 illustrated in FIGS. 2A-5, 7, 8, and 9C.

The foregoing examples and illustrative implementations of various embodiments have been provided merely for explanation and are in no way to be construed as limiting of the embodiments disclosed herein. Dimensions of various parts of the anti-dropping storage drawer disclosed above are exemplary, and are not limiting of the scope of the embodiments herein. While the embodiments have been described with reference to various illustrative implementations, drawings, and techniques, it is understood that the words, which have been used herein, are words of description and illustration, rather than words of limitation. Furthermore, although the embodiments have been described herein with reference to particular means, materials, techniques, and implementations, the embodiments herein are not intended to be limited to the particulars disclosed herein; rather, the embodiments extend to all functionally equivalent structures, methods and uses, such as are within the scope of the appended claims. It will be understood by those skilled in the art, having the benefit of the teachings of this specification, that the embodiments disclosed herein are capable of modifications and other embodiments may be effected and changes may be made thereto, without departing from the scope and spirit of the embodiments disclosed herein.

I claim:

1. An anti-dropping storage drawer comprising:

a pair of side walls, a front wall, and a rear wall together configured to form a generally rectangular-shaped box, wherein the front wall and the rear wall extend between the pair of side walls;

a base portion extending between bottom portions of the pair of side walls, a bottom portion of the front wall, and a bottom portion of the rear wall; and one or more projections projecting downwards from an underside of the base portion, wherein the projections are spaced apart from each other, wherein the projections are ribs, and wherein the ribs are disposed substantially parallel to the front wall and the rear wall.

2. The anti-dropping storage drawer of claim 1, wherein the ribs are disposed substantially parallel to each other on the underside of the base portion.

3. The anti-dropping storage drawer of claim 1, wherein the at least one rib is configured to extend along a width of the anti-dropping storage drawer between the pair of side walls.

4. The anti-dropping storage drawer of claim 1, wherein the at least one rib disposed on the underside of the base portion is configured to project downwards and substantially perpendicular to the underside of the base portion.

5. The anti-dropping storage drawer of claim 1, wherein the pair of side walls, the front wall, the rear wall, and the base portion define a cavity.

6. The anti-dropping storage drawer of claim 5, wherein the pair of side walls, the front wall, and the rear wall taper outward toward an opening of the cavity.

7. The anti-dropping storage drawer of claim 1, wherein each of the side walls comprises a ledge extending along a length of the each of the side walls and located proximal to a mid-section of the each of the side walls, wherein the ledge is configured to separate the each of the side walls into an upper section and a lower section, and wherein the ledge is configured to project outwards from a top of the lower section of the each of the side walls, and wherein the upper section of the each of the side walls is configured to extend upwards from an edge of the ledge of the each of the side walls.

8. The anti-dropping storage drawer of claim 1, further comprising a downwardly extending lip extending from a top of the front wall.

9. The anti-dropping storage drawer of claim 1, further comprising a plurality of divider slots disposed on inner surfaces of upper sections of the pair of side walls, and a plurality of divider slots disposed on inner surfaces of lower sections of the pair of side walls.

10. The anti-dropping storage drawer of claim 9, wherein each of the plurality of divider slots disposed on the inner surfaces of the upper sections of the pair of side walls is aligned with a corresponding one of the plurality of divider slots disposed on the inner surfaces of the lower sections of the pair of side walls.

11. An anti-dropping storage drawer comprising:

a pair of side walls, a front wall, and a rear wall together configured to form a generally rectangular-shaped box, wherein the front wall and the rear wall extend between the pair of side walls;

a base portion extending between bottom portions of the pair of side walls, a bottom portion of the front wall, and a bottom portion of the rear wall;

at least one projection projecting downwards from an underside of the base portion;

wherein the anti-dropping storage drawer is configured to slide in and out of a slot in a storage unit, wherein the at least one projection is configured to engage with a lower lip of the storage unit when the anti-dropping storage drawer is pulled out of the slot in the storage unit, and wherein the at least one projection is configured to block a forward and downward movement of the anti-dropping storage drawer out of the storage unit when the anti-dropping storage drawer inclines forward with respect to a horizontal plane.

12. An anti-dropping storage drawer comprising:

a pair of side walls, a front wall, and a rear wall together configured to form a generally rectangular-shaped box, wherein the front wall and the rear wall extend between the pair of side walls and are substantially perpendicular to the pair of side walls;

a base portion extending between bottom portions of the pair of side walls, a bottom portion of the front wall, and a bottom portion of the rear wall; and a plurality of projections projecting from an underside of the base portion, wherein one of the projections is configured to engage with a lower lip of a storage unit when the anti-dropping storage drawer is pulled out of a slot in the storage unit, and wherein the one of the projections is configured to block a forward and downward movement of the anti-dropping storage drawer out of the storage unit when the anti-dropping storage drawer inclines forward with respect to a horizontal plane.

13. The anti-dropping storage drawer of claim 12, wherein the projections projecting from the underside of the base portion are ribs, and wherein the ribs are disposed substantially parallel to the front wall and the rear wall.

14. The anti-dropping storage drawer of claim 13, wherein the ribs are spaced apart from and disposed substantially parallel to each other on the underside of the base portion.

15. The anti-dropping storage drawer of claim 13, wherein the ribs are configured to extend along a width of the anti-dropping storage drawer between the pair of side walls.

16. The anti-dropping storage drawer of claim 13, wherein the ribs disposed on the underside of the base portion are configured to project downward and substantially perpendicular to the underside of the base portion.

17. The anti-dropping storage drawer of claim 12, wherein the pair of side walls, the front wall, the rear wall, and the base portion define a cavity, and wherein the pair of side walls, the front wall, and the rear wall taper outward toward an opening of the cavity.

18. The anti-dropping storage drawer of claim 12, wherein each of the side walls comprises a ledge extending along a length of the each of the side walls and located proximal to a mid-section of the each of the side walls, wherein the ledge is configured to separate the each of the side walls into an upper section and a lower section, and wherein the ledge is configured to project outwards from a top of the lower section of the each of the side walls, and wherein the upper section of the each of the side walls is configured to extend upwards from an edge of the ledge of the each of the side walls.

19. The anti-dropping storage drawer of claim 12, further comprising a downwardly extending lip extending from a top of the front wall, wherein the downwardly extending lip is configured to allow a user to grip and slide the anti-dropping storage drawer in and out of the slot in the storage unit.

20. The anti-dropping storage drawer of claim 12, further comprising a plurality of divider slots disposed on inner surfaces of upper sections of the pair of side walls, and a plurality of divider slots disposed on inner surfaces of lower sections of the pair of side walls, wherein the divider slots on the pair of side walls are configured to accommodate dividers within a cavity of the anti-dropping storage drawer for dividing the cavity into compartments in the anti-dropping storage drawer.

21. The anti-dropping storage drawer of claim 20, wherein each of the plurality of divider slots disposed on the inner surfaces of the upper sections of the pair of side walls is aligned with a corresponding one of the plurality of divider slots disposed on the inner surfaces of the lower sections of the pair of side walls.

* * * * *